US011008795B1

(12) United States Patent
Dixon et al.

(10) Patent No.: US 11,008,795 B1
(45) **Date of Patent: *May 18, 2021**

(54) DOOR WITH HIDDEN DOOR CLOSER

(71) Applicant: Larson Manufacturing Company of South Dakota, Inc., Brookings, SD (US)

(72) Inventors: Alan M. Dixon, Brookings, SD (US); Michael W. Kondratuk, Brookings, SD (US); Allen E. Lee, Brookings, SD (US); Kelly D. Nordgaard, Gary, SD (US); Jordan A. Richter, Coralville, IA (US); Todd N. Stratmoen, Brookings, SD (US); Bryan P. Zacher, Brookings, SD (US)

(73) Assignee: Larson Manufacturing Company of South Dakota, LLC, Brookings, SD (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/914,850

(22) Filed: Jun. 29, 2020

Related U.S. Application Data

(63) Continuation of application No. 15/382,275, filed on Dec. 16, 2016, now Pat. No. 10,774,570.

(60) Provisional application No. 62/268,810, filed on Dec. 17, 2015.

(51) Int. Cl.

| | |
|---|---|
| ***E05F 3/22*** | (2006.01) |
| ***E05F 1/10*** | (2006.01) |
| ***E06B 3/28*** | (2006.01) |
| ***E06B 3/40*** | (2006.01) |

(Continued)

(52) U.S. Cl.

CPC ..... *E05F 3/227* (2013.01); *E05F 1/105* (2013.01); *E05F 1/1091* (2013.01); *E06B 3/28* (2013.01); *E06B 3/40* (2013.01); *E06B 3/70* (2013.01); *E05F 2003/228* (2013.01); *E05F 2015/631* (2015.01); *E05Y 2900/132* (2013.01); *E06B 2003/7046* (2013.01); *E06B 2003/7049* (2013.01); *E06B 2003/7055* (2013.01); *E06B 2003/7059* (2013.01)

(58) Field of Classification Search

CPC ..... E06B 7/2316; E06B 2003/7055; E05F 1/105; E05F 3/227; E05F 2015/631; E05F 2003/228

See application file for complete search history.

(56) References Cited

U.S. PATENT DOCUMENTS 1,895,895 A * 1/1933 Norton ..... E05F 3/227 16/49
2,144,406 A 1/1939 Gunter
(Continued)

FOREIGN PATENT DOCUMENTS

CA 2924872 A1 4/2015
DE 102014102004 A1 8/2015
(Continued)

*Primary Examiner* — Marcus Menezes
(74) *Attorney, Agent, or Firm* — Kagan Binder, PLLC

(57) ABSTRACT

The present disclosure describes various embodiments of a concealed or hidden door closer that is installed in a rail of a door assembly. In some embodiments, the door frame and door closer components are configured to allow the door assembly to be readily installed as either a left or a right hand hinged door.

27 Claims, 27 Drawing Sheets

(51) Int. Cl.
*E06B 3/70* (2006.01)
*E05F 15/63* (2015.01)

(56) References Cited

U.S. PATENT DOCUMENTS 2,958,089 A * 11/1960 Roehm ..... E05C 17/24 16/49
3,415,562 A 12/1968 Petersen
3,601,842 A * 8/1971 Morrison ..... E05C 17/28 16/49
3,605,339 A 9/1971 Catlett et al.
4,001,972 A * 1/1977 Hurwitz ..... E06B 3/72 49/380
4,348,835 A 9/1982 Jones et al.
4,506,407 A * 3/1985 Downey ..... E05F 3/222 16/320
4,759,099 A 7/1988 Morano et al.
5,327,684 A * 7/1994 Herbst ..... E05D 7/02 16/249
5,653,068 A * 8/1997 Moody ..... E06B 7/26 49/408
5,829,508 A * 11/1998 DeBower ..... E05F 3/221 160/371
6,049,287 A * 4/2000 Yulkowski ..... A62C 2/24 292/251.5
6,412,224 B1 * 7/2002 Feucht ..... E05F 3/10 49/333
6,481,160 B1 11/2002 Kowalczyk
6,499,185 B1 * 12/2002 Moyer ..... E05F 3/222 16/51
6,581,332 B1 6/2003 Kim
6,588,153 B1 7/2003 Kowalczyk
6,705,047 B2 3/2004 Yulkowski
8,261,491 B2 * 9/2012 Yulkowski ..... E05F 15/63 49/358
8,405,337 B2 3/2013 Gebhart et al.
8,844,200 B2 * 9/2014 Yulkowski ..... E05F 15/63 49/358
8,938,912 B2 1/2015 McKibben et al.
9,556,659 B2 * 1/2017 Fan ..... E05F 3/02
9,574,389 B2 * 2/2017 Menze ..... E05F 3/224
9,822,569 B2 * 11/2017 Wang ..... E05F 3/02
10,161,172 B2 * 12/2018 Worner ..... E05F 1/1083
2002/0108312 A1 8/2002 Abdella et al.
2005/0193632 A1 9/2005 Orban et al.
2007/0256362 A1 * 11/2007 Hansen ..... E05F 15/63 49/32
2013/0118079 A1 * 5/2013 Yulkowski ..... E05F 15/00 49/31
2015/0308180 A1 10/2015 Meeks
2017/0159339 A1 * 6/2017 McKibben ..... E05F 1/1246
2018/0298664 A1 * 10/2018 Sauter ..... E05F 15/63

FOREIGN PATENT DOCUMENTS

EP 0764752 A2 * 3/1997 ..... E05F 3/223
EP 0764752 A2 3/1997
EP 1094186 A1 4/2001
WO WO-0111173 A1 * 2/2001 ..... E05F 15/614
WO 2010107168 A1 9/2010
WO 2015058035 A1 4/2015
WO WO-2015058035 A1 * 4/2015 ..... E05F 1/105

* cited by examiner

DOOR WITH HIDDEN DOOR CLOSER

CROSS-REFERENCE TO RELATED APPLICATIONS

This application is a continuation application of U.S. application Ser. No. 15/382,275, filed on Dec. 16, 2016, which claims the benefit of U.S. Provisional Patent Application No. 62/268,810, filed Dec. 17, 2015 and titled "DOOR WITH HIDDEN DOOR CLOSER," which are incorporated herein by reference in their entireties.

Commonly owned pending applications that report various embodiments of a door with a hidden closer include U.S. patent application Ser. No. 15/385,091 filed Dec. 20, 2016; Ser. No. 15/911,639 filed Mar. 5, 2018; and Ser. No. 15/911,690 filed Mar. 5, 2018.

TECHNICAL FIELD

The present disclosure is generally directed to a door assembly having a concealed or hidden door closer. In particular, the hidden door closer may be inserted in a pocket in an upper horizontal rail of the door. The inserted door closer is attached to a closer arm that is connected to a sliding fixture that can be inserted into a slide track that is associated with a drip cap mounted to the upper header of a door frame. In use, the door closer provides sufficient force to the closer arm to move the door from an opened position to a closed position.

BACKGROUND

Door closers have been used for many years. These closers run the gamut from weights which travel about a pulley to open and close the door to spring-loaded hinges in which a torsion spring is coaxial with the hinge pin. Other closers, for example, use one or more externally mounted pneumatic or hydraulic cylinders while still other closers use a complex hydraulic mechanism in combination with a folding linkage attached to the top of the door. Not only do these reported closer designs vary in effectiveness in reliably closing the door, many of these closer designs also detract from the aesthetic appearance of the door since they are mounted as an appendage to the surface of the door.

Hollow interior portions of a wide variety of doors, such as screen doors, storm doors, exterior doors, or interior doors, lend themselves to the potential of mounting a door closer in the interior structure of these doors. U.S. Pat. No. 5,829,508, for example, reports an interior mounted door closer with a spring-mounted, sliding closer mechanism fitted in the upper part of the door. This reported closer includes a number of moving parts that are installed in the upper internal section of the door. There is a need for a hidden closer that is simply easier to install and use than previously reported closers.

SUMMARY

The present disclosure describes various embodiments of a concealed or hidden door closer that is installed in an upper rail of a door assembly. In some embodiments, the door frame and door closer components are configured to allow the door assembly to be readily installed as either a left or a right hand hinged door.

In one embodiment (2 Closer Pockets in Upper Rail), this disclosure describes a door assembly, comprising:

a door having first and second vertical stiles attached to upper and lower horizontal rails, the upper horizontal rail having two closer pockets located in regions of the upper horizontal rail adjacent to the first and second vertical stiles;

a drip cap having a horizontal body with first and second ends;

a slide track associated with the drip cap and horizontally extending between the first and second ends of the drip cap;

a closer insertable into one of the pockets of the upper horizontal rail comprising a closer body having one or more mounting tabs fastened to the top or bottom of the closer body attached to the upper horizontal rail, and a vertical pinion rotatably connected to an internal biasing mechanism such as a biasing spring and having at least one connecting stud extending through the closer body, wherein the vertical pinion provides sufficient rotational force to move the door from an opened position to a closed position; and a closer arm having an attachment fixture on one end of the closer arm attachable to the vertical pinion connecting stud and a slide fixture on an opposite end of the closer arm insertable into the slide track.

In this described embodiment, the door assembly may be installed as either a left hinged or a right hinged door. Those skilled in the art will readily recognize that the door assembly may be configured for either a left hinged or a right hinged installation because of the symmetry of this door assembly about a vertical axis of this door assembly.

In another embodiment (One Closer Pocket in both Upper and Lower Rails), this disclosure describes a door assembly, comprising:

a door having a vertical latch stile and a vertical hinge stile attached to upper and lower horizontal rails, the upper and lower horizontal rails each having a closer pocket located in a region of the horizontal rail adjacent to the vertical hinge stile;

a drip cap having a horizontal body with first and second ends;

a slide track associated with the drip cap and horizontally extending between the first and second ends of the drip cap;

a closer insertable into the pocket of the upper horizontal rail comprising a closer body having one or more mounting tabs fastened to the top or bottom of the closer body attached to the upper horizontal rail, and a vertical pinion rotatably connected to an internal biasing mechanism such as a biasing spring and having at least one connecting stud extending through the closer body, wherein the vertical pinion provides sufficient rotational force to move the door from an opened position to a closed position; and a closer arm having an attachment fixture on one end of the closer arm attachable to the vertical pinion connecting stud and a slide fixture on an opposite end of the closer arm insertable into the slide track. In this described embodiment, the door assembly may be installed as either a left hinged or a right hinged door. Those skilled in the art will readily recognize that a left hinged door assembly of this embodiment may be configured to a right hinged door assembly when the door assembly is rotated 180° from top to bottom during installation because of the symmetry of this door assembly about a horizontal axis of this door assembly.

In still another embodiment (One Closer Pocket in the Center of the Upper Rail), this disclosure describes a door assembly, comprising:

a door having first and second vertical stiles attached to upper and lower horizontal rails, the upper horizontal rail having first and second ends and a closer pocket located in a center region of the upper horizontal rail between the first and second ends;

a drip cap having a horizontal body with a first end and a second end;

a slide track associated with the drip cap and extending between the first and second ends of the drip cap;

a closer insertable into the pocket of the upper horizontal rail comprising a closer body having one or more mounting tabs fastened to the top or bottom of the closer body attachable to the upper horizontal rail, and a vertical pinion, optionally fitted in, or offset from, a center position of the closer body, that is rotatably connected to an internal biasing mechanism such as a biasing spring, and having at least one connecting stud extending through the closer body, wherein the vertical pinion provides sufficient rotational force to move the door from an opened position to a closed position; and a closer arm having an attachment fixture on one end of the closer arm attachable to the vertical pinion connecting stud and a slide attachment fixture on an opposite end of the closer arm insertable into the slide track.

In this described embodiment, the door assembly may be installed as either a left hinged or a right hinged door. Those skilled in the art will readily recognize that the door assembly may be configured for either a left hinged or a right hinged installation because of the symmetry of this door assembly about a vertical axis of this door assembly.

In still another embodiment (One Closer Pocket in the Center of the Upper and Lower Rail), this disclosure describes a door assembly, comprising:

a door having first and second vertical stiles attached to upper and lower horizontal rails, the upper and lower horizontal rails having first and second ends and a closer pocket located in a center region of the upper and lower horizontal rails between the first and second ends;

a drip cap having a horizontal body with a first end and a second end;

a slide track associated with the drip cap and extending between the first and second ends of the drip cap;

a closer insertable into the pocket of the upper horizontal rail comprising a closer body having one or more mounting tabs fastened to the top or bottom of the closer body attachable to the upper horizontal rail, and a vertical pinion, optionally fitted in, or offset from, a center position of the closer body, that is rotatably connected to an internal biasing mechanism such as a biasing spring, and having at least one connecting stud extending through the closer body, wherein the vertical pinion provides sufficient rotational force to move the door from an opened position to a closed position; and a closer arm having an attachment fixture on one end of the closer arm attachable to the vertical pinion connecting stud and a slide attachment fixture on an opposite end of the closer arm insertable into the slide track.

In this described embodiment, the door assembly may be installed as either a left hinged or a right hinged door. Those skilled in the art will readily recognize that a left hinged door assembly of this embodiment may be configured to a right hinged door assembly when the door assembly is rotated 180° from top to bottom during installation because of the symmetry of this door assembly about a horizontal axis of this door assembly.

In yet another embodiment (Pocket in Upper Rail for Left or Right Hand Door), this disclosure describes a door assembly, comprising:

a door having an optional left or right hand vertical latch stile and an optional right or left hand vertical hinge stile attached to upper and lower horizontal rails, the upper horizontal rail having a closer pocket located in a region of the horizontal rail adjacent to the vertical hinge stile;

a drip cap having a horizontal body with first and second ends;

a slide track associated with the drip cap and horizontally extending between the first and second ends of the drip cap;

a closer insertable into the pocket of the upper horizontal rail comprising a closer body having one or more mounting tabs fastened to the top or bottom of the closer body attached to the upper horizontal rail, and a vertical pinion rotatably connected to an internal biasing mechanism such as a biasing spring and having at least one connecting stud extending through the closer body, wherein the vertical pinion provides sufficient rotational force to move the door from an opened position to a closed position; and a closer arm having an attachment fixture on one end of the closer arm attachable to the vertical pinion connecting stud and a slide attachment fixture on an opposite end of the closer arm insertable into the slide track.

In the embodiments set out above, the door may be in a variety of configurations such as, for example, a full view door, a high view door, or a mid-view door. The described doors may also be interchangeable doors or self-storing doors. For example, in some embodiments the glass and screen panels may be exchanged seasonally. Alternatively, the glass and screen panels may be stored in designated sections of the door and either the glass or screen may be moved into place when it is desired to have either the screen or the glass in view.

In addition, the embodiments described above may include additional components. In some embodiments, the door assembly may include a vertical hinge frame attached to at least one of the vertical stiles to provide either the left or right hinged door. In other embodiments, the door assembly may also include latching components attachable to at least one of the vertical stiles where the latch mechanism is externally mounted to at least one of the vertical stiles, or alternatively the latch mechanism is internally mounted in a latch pocket in at least one of the vertical stiles. In still other embodiments, the door assembly includes a vertical latch frame attached to a door jamb adjacent at least one of the vertical stiles where the vertical latch frame has optional fixtures to receive the latching components of the latch mechanism. In yet other embodiments, the door assembly may include a slide track that is an integral component of the drip cap, or alternatively the door assembly may include a slide track that is a component associated with or attachable to the drip cap.

Further, various embodiments of a closer may be used with the disclosed door assemblies. The closer, for example, may include a biasing mechanism such as an internal biasing spring that provides a torsional force or linear force. Other alternative biasing mechanisms may include compressible and/or expandable materials such as fluids or gases which may be used alone or in combination with, for example, biasing springs. In addition, the closer may be set to close the door at a consistent speed or a variable speed. In some embodiments, the closer may have vertical pinion that has both upper and lower connecting studs extending through a top and bottom of the closer body. In this embodiment, an upper connecting stud will rotate clockwise when the closer is in a first orientation in the closer pocket, and counterclockwise when the closer is in a second orientation in the closer pocket. In other embodiments, the closer may have a connecting stud that rotates either clockwise or counterclockwise when displaced or otherwise moved from a center biased position. In still other embodiments, the closer may have connecting studs that are attached to separate pinions, both extending through the same side of closer body, with one pinion and stud rotating in a clockwise direction and the other pinion and stud rotating in a counterclockwise direction. In some embodiments, the closer arm may be comprised of multiple linked segments, and may be connected directly to the drip cap or the frame of the opening into which the entire door assembly is installed without the use of a slide fixture or slide track. In still other embodiments, the closer may include a dampener component to control the closing speed of the door.

In an alternative embodiment, this disclosure describes a door kit comprising:

- a door having a first vertical latch stile and a second vertical hinge stile, both stiles attached to upper and lower horizontal rails, the upper horizontal rail optionally having one closer pocket adjacent to a vertical hinge stile, one closer pocket in a center region of the upper horizontal rail, or two closer pockets located in regions of the upper horizontal rail adjacent to the first and second vertical stiles, and the lower horizontal rail optionally having one closer pocket adjacent to a vertical hinge stile or one closer body in a center region of the lower horizontal rail;
- a drip cap having a horizontal body with first and second ends;
- a slide track associated with the drip cap horizontally extending between the first and second ends of the drip cap;
- a closer insertable into one of the pockets of the upper horizontal rail or lower horizontal rail comprising a closer body having one or more mounting tabs fastened to the top or bottom of the closer body attached to the upper horizontal rail or lower horizontal rail, and a vertical pinion rotatably connected to a biasing mechanism such as an internal biasing spring and having at least one connecting stud extending through the closer body, wherein the vertical pinion provides sufficient rotational force to move the door from an opened position to a closed position;
- a closer arm having an attachment fixture on one end of the closer arm attached to the vertical pinion connecting stud and a slide fixture on an opposite end of the closer arm insertable into the slide track;
- an optional expander attachable to the lower horizontal rail;
- a latch mechanism having latching components attachable to at least one of the vertical stiles in either an internal or an external configuration;
- a vertical latch frame having optional fixtures to receive the latching components of the latch mechanism;
- a vertical hinge frame attachable to at least one of the vertical stiles to provide either a left or right hinged door;
- an optional cover attachable to the upper or lower horizontal rails to conceal at least one of the closer pockets;
- an optional hold-open stop in the slide track,
- an optional linked, segmented closer arm, and
- an optional screen insert, or one or more glass inserts, or both.

Such door kits may be for a full view door, a high view door, or a mid-view door as well as an interchangeable door or a self-storing door. For example, in some embodiments the glass and screen panels may be exchanged seasonally. Alternatively, the glass and screen panels may be stored in designated sections of the door and either the glass or screen may be moved into place when it is desired to have either the screen or the glass in view. In this described embodiment, those skilled in the art will readily recognize that the door kit may be installed as either a left hinged or a right hinged door depending on whether it is symmetric about a horizontal or about a vertical axis of the door.

In another alternative embodiment, this disclosure describes a method of mounting a door within a framed door opening comprising:

a) providing a door assembly comprising 1) a door having vertical latch stile and a vertical hinge stile, both stiles attached to upper and lower horizontal rails, the upper horizontal rail optionally having one closer pocket adjacent to a vertical hinge stile, one closer pocket in a center region of the upper horizontal rail, or two closer pockets located in regions of the upper horizontal rail adjacent to the vertical latch and hinge stiles, and the lower horizontal rail optionally having one closer pocket adjacent to a vertical hinge stile, or one closer pocket on a center region of the lower horizontal rail;
2) a drip cap having a horizontal body with first and second ends;
3) a slide track associated with the drip cap horizontally extending between the first and second ends of the drip cap;
4) a closer insertable into one of the pockets of the upper or lower horizontal rails comprising a closer body having first and second mounting tabs fastened to the top or bottom of the closer body attachable to the upper horizontal rail or lower horizontal rail, and a vertical pinion rotatably connected to a biasing mechanism such as an internal biasing spring and having at least one connecting stud extending through the closer body, wherein the vertical pinion provides sufficient rotational force to move the door from an opened position to a closed position;
5) a closer arm having an attachment fixture on one end of the closer arm attached to the vertical pinion connecting stud and a slide fixture on an opposite end of the closer arm insertable into the slide track;
6) an optional expander attachable to the second lower horizontal rail;
7) a latch mechanism having latching components attachable to at least one of the vertical stiles in either an external or internal configuration;
8) a vertical latch frame having optional fixtures to receive the latching components of the latch mechanism;
9) a vertical hinge frame attachable to at least one of the vertical stiles to provide either a left or right hinged door;

10) an optional cover attachable to the upper or lower horizontal rail to conceal at least one of the unused closer pockets; and 11) an optional hold-open stop in the slide track;

12) an optional linked, segmented closer arm; and 13) an optional screen insert, or one or more glass inserts, or both;

b) attaching the vertical hinge stile of the door assembly to a door jamb with the vertical hinge frame;

c) inserting the slide fixture and optional hold-open stop into the slide track;

d) attaching the drip cap to the door header;

e) attaching the vertical latch frame to the door jamb adjacent the vertical latch stile;

f) attaching the latch mechanism externally to or internally in the vertical latch stile;

g) attaching the closer arm to one of the closer pinion connecting studs;

h) inserting the closer into one of the closer pockets in the upper horizontal rail and attaching the closer to the rail;

i) attaching the closer arm to the sliding fixture;

j) attaching the optional cover to conceal at least one of the unused closer pockets;

k) attaching the optional expander to the lower horizontal rail; and l) attaching the screen insert and/or one or more glass inserts in the door.

In some of the embodiments of this method, the installer will decide to install the door assembly as either a left hinged or right hinged door. In embodiments where the door is symmetrical about a horizontal axis, the installer would understand or be instructed to rotate the door assembly 180° from top to bottom in order to allow either a left hinged or a right hinged installation of the door assembly. In other embodiments where the door is symmetrical about a vertical axis, the installer would understand or be instructed to configure the door assembly in order to allow either a left hinged or a right hinged installation of the door assembly.

DETAILED DESCRIPTION

The present disclosure is generally directed to a door assembly having a concealed or hidden door closer. In particular, the door closer is inserted in a pocket in an upper horizontal rail of the door. The inserted door closer is attached to a closer arm that is connected to a sliding fixture insertable into a slide track that is associated with or a part of a drip cap mounted to the upper header of a door frame. In use, the door closer provides sufficient force to the closer arm to move the door from an opened position to a closed position.

Figure 1A:
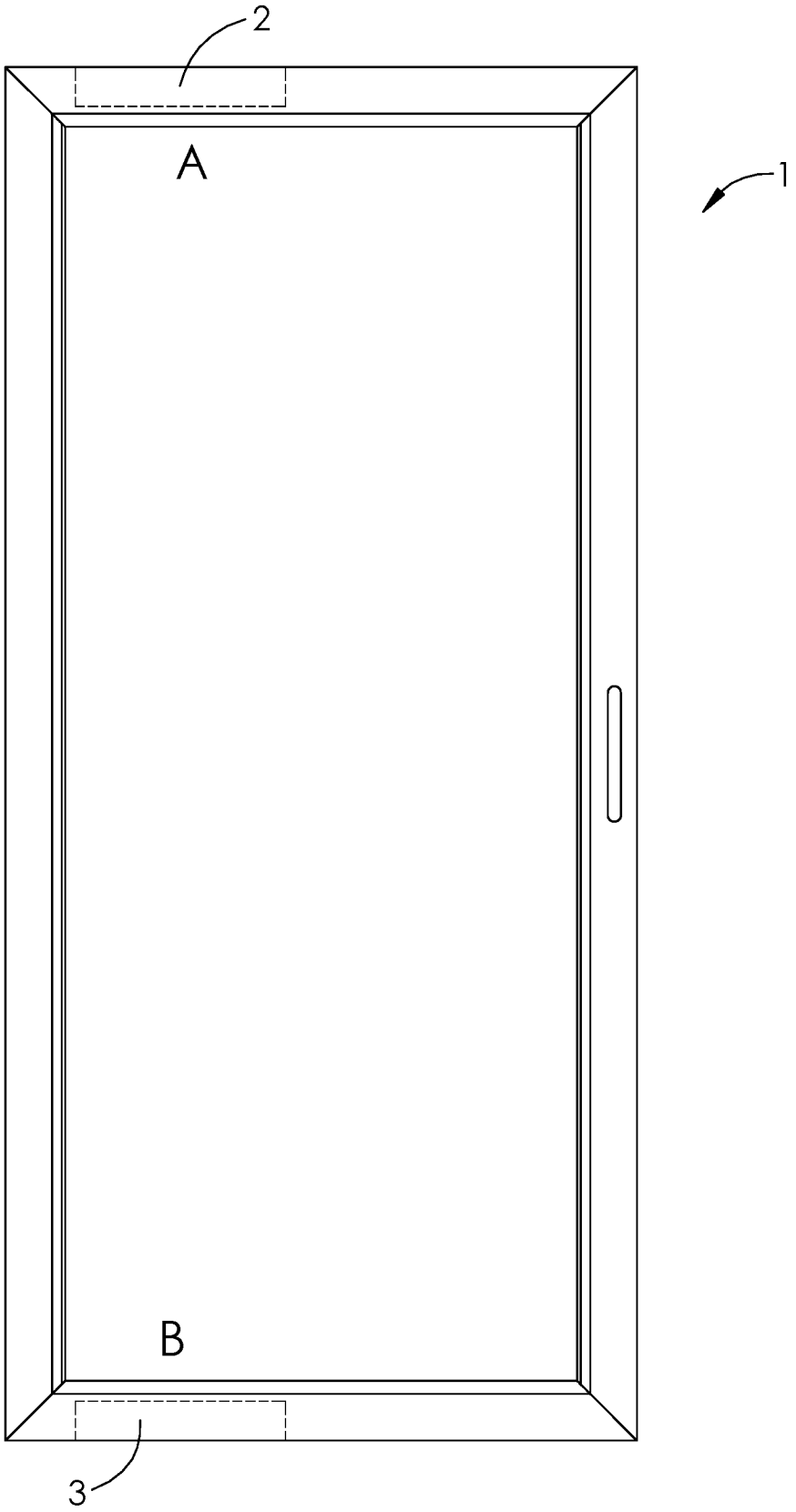
FIGS. 1A-1G are front exterior views of different embodiments of doors with alternative closer pocket configurations.
Figure 1B:
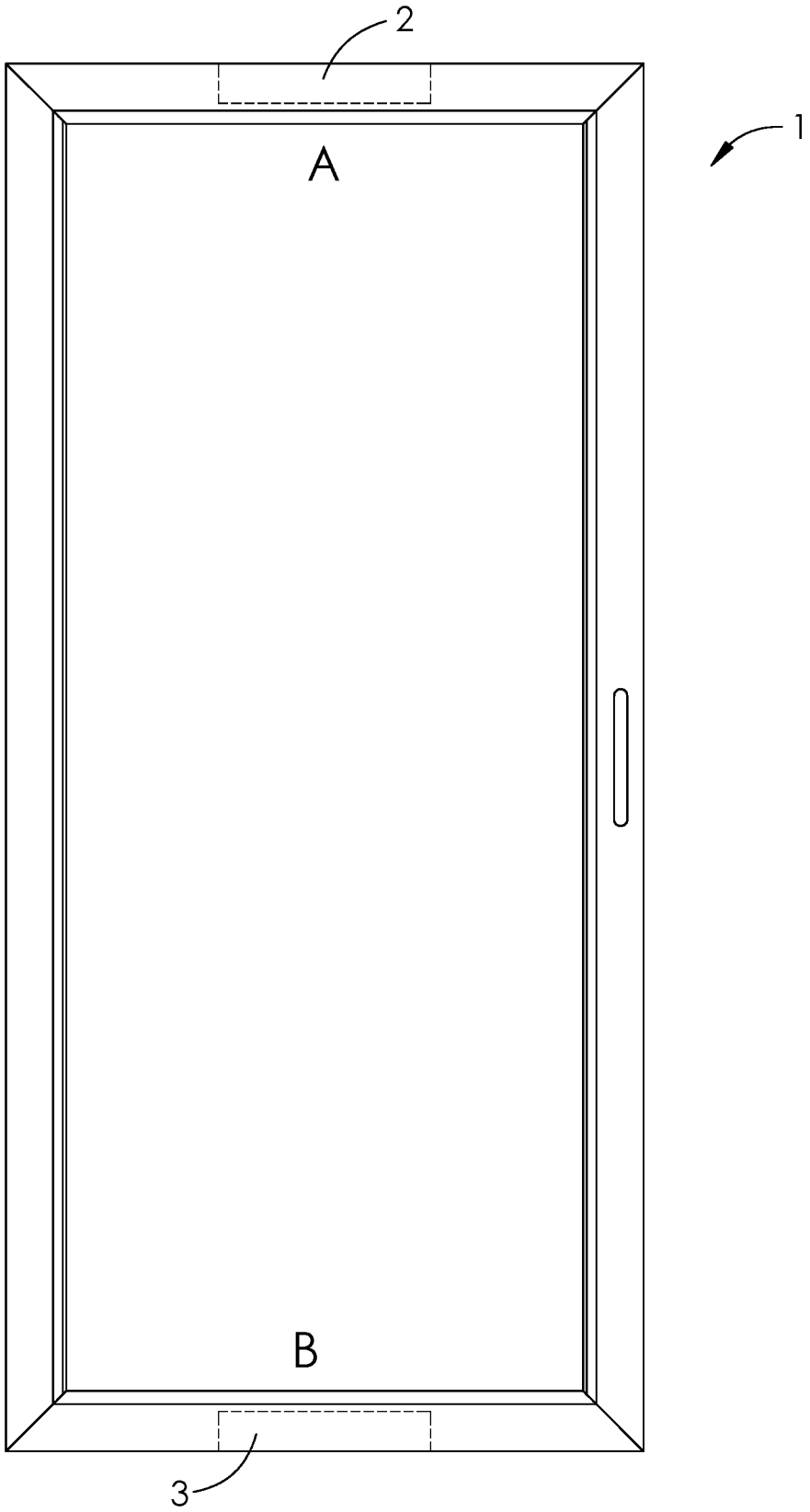
Figure 1C:
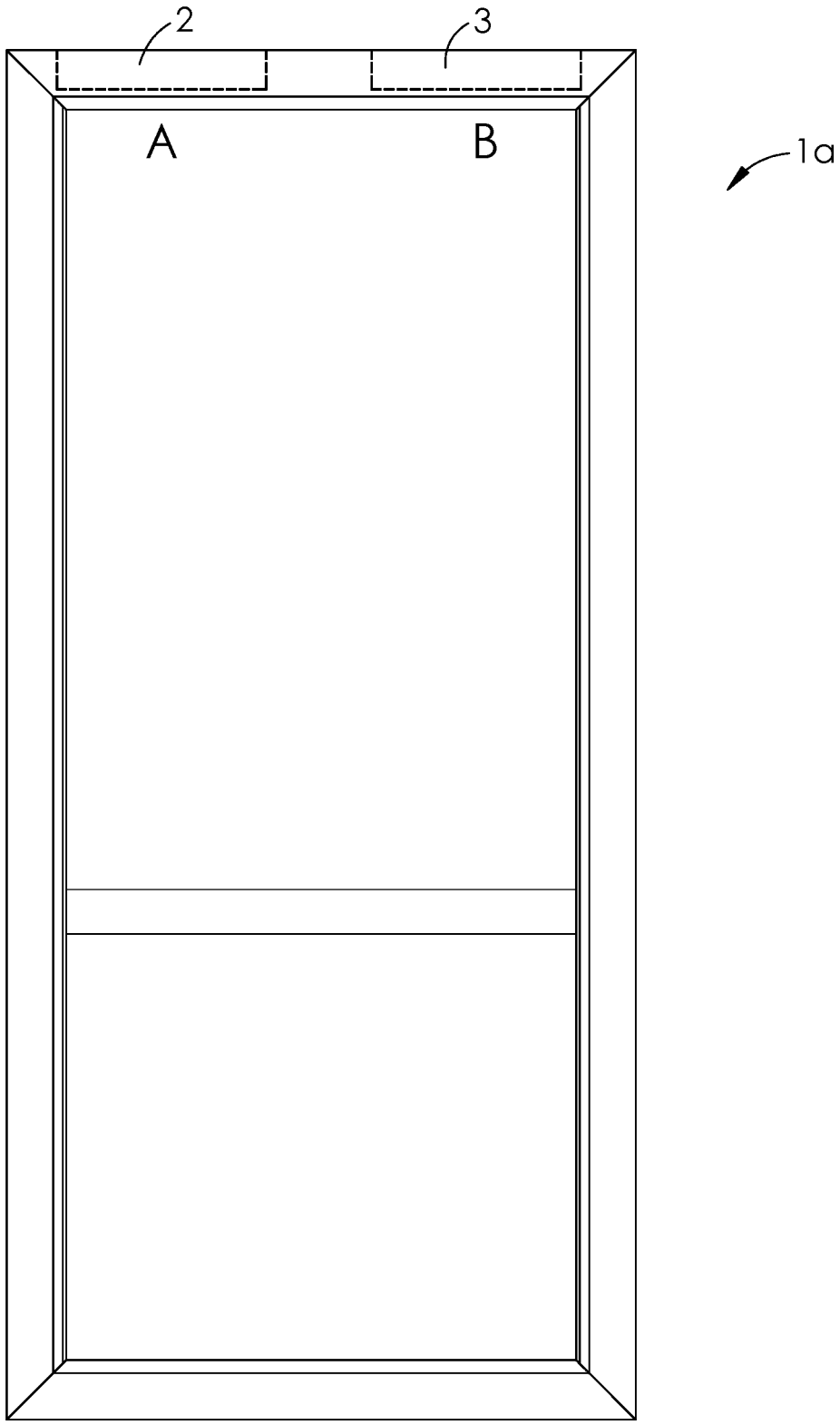
Figure 1D:
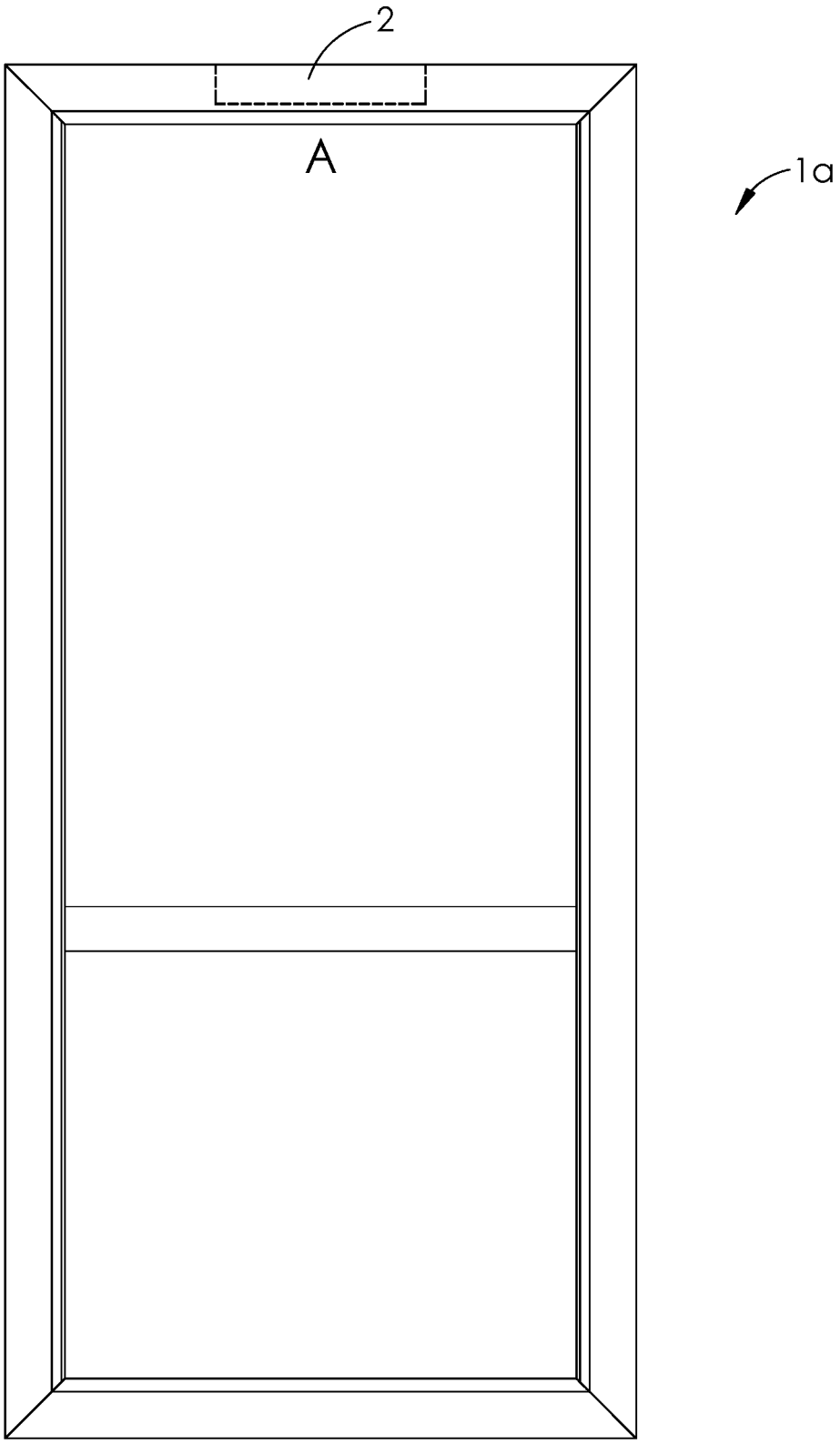

FIGS. 1A-1D illustrate alternative configurations of door assemblies that may be used as either left hinged or right hinged doors. These different embodiments of door assemblies differ by the location of the upper and/or lower rail closer pockets and by the location of the latch mechanism holes, openings or cutouts (or absence of latch mechanism holes, openings or cutouts) in the latch stile that would be used for attaching or fitting an internal latch mechanism to the latch stile. In alternative embodiments, an external latch mechanism may be used if the latch stile does not have any holes, opening or cutouts, or alternatively these holes, openings or cutouts may be made by an installer to either a left or right hinged door assembly during installation if an internal latch mechanism is desired. FIG. 1A includes two door closer pockets, pockets A 2 and B 3, one pocket adjacent the hinge stile in both of the upper and lower rails. When the door assembly is to be used as a left hinged door, closer pocket A 2 is used for fitting or mounting a door closer. When the door assembly is to be used as a right hinged door, the door assembly is turned or rotated top-for-bottom, and pocket B 3 is used for fitting or mounting a door closer. When the door assembly is rotated in this top-for-bottom manner, the latch pocket or cutout changes position from being located in a right hand side stile to being located in a left hand side stile. FIG. 1B includes two closer pockets A 2 and B 3, one pocket in the center region of both of the upper and lower rails. In this configuration, the door closer may be configured to have the vertical pinion centered in the closer body or, alternatively, the closer body may be configured to have the vertical pinion of the closer offset in the closer body so that when the closer arm is attached or connected to the door closer arm is offset from the centerline of the door assembly nearer to the hinge stile section of the upper rail. The offset towards the hinge stile prevents the door closer, closer arm and sliding attachment fixture from binding as the door is opened and closed. When the door assembly is to be used as a right hinged door, the door assembly is turned or rotated top-for-bottom, and pocket B 3 is used for fitting or mounting a door closer. When the door assembly is rotated in this top-for-bottom manner, the latch pocket or cutout changes position from being located in a right hand side stile to being located in a left hand side stile. FIG. 1C includes two closer pockets in the upper rail of the door frame. When the door frame 1*a* is to be used as a left hinged door, the door closer is attached or fitted in closer pocket A 2. An external latch mechanism is then attached or fitted to the right hand side stile. When the door frame 1*a* is to be used as a right hinged door, the door closer is attached or fitted in closer pocket B and an external latch mechanism is then attached or fitted to the left hand side stile. In either of the embodiments of FIG. 1C, latch cutouts can be made by the installer in the field at the installation site if an internal latch mechanism, as compared to an external latch mechanism, is desired. FIG. 1D illustrates a door assembly 1*a* that includes a single closer pocket 2 in the upper rail of the door assembly. When the door assembly is to be used as a left hinged door, the door closer may be configured to have the vertical pinion centered in the closer body or, alternatively, the closer body may be configured to have the vertical pinion of the closer offset in the closer body so that the closer arm is attached or connected to the door closer offset from the centerline of the door frame. For example, the closer body pinion may be positioned nearer to the left hand side hinge stile. The offset toward the left hand side hinge stile prevents the door closer, closer arm and sliding attachment fixture from binding as the door is opened and closed. A latch mechanism is then attached or fitted to the right hand side stile. When the door assembly is to be used as right hinged door, the door closer is attached or fitted in closer pocket A and the vertical pinion of the closer body may be positioned, for example, so that it is located in a centered position in the closer pocket or may be positioned nearer to the right hand hinge stile. The offset toward the right hand side hinge stile prevents the door closer, closer arm and sliding attachment fixture from binding as the door is opened and closed. A latch mechanism is then attached or fitted to the left hand side stile. In either of the embodiments of FIG. 1D, latch cutouts can be made by the installer in the field at the installation site if an internal latch mechanism, as compared to an external latch mechanism, is desired.

Figure 1E:
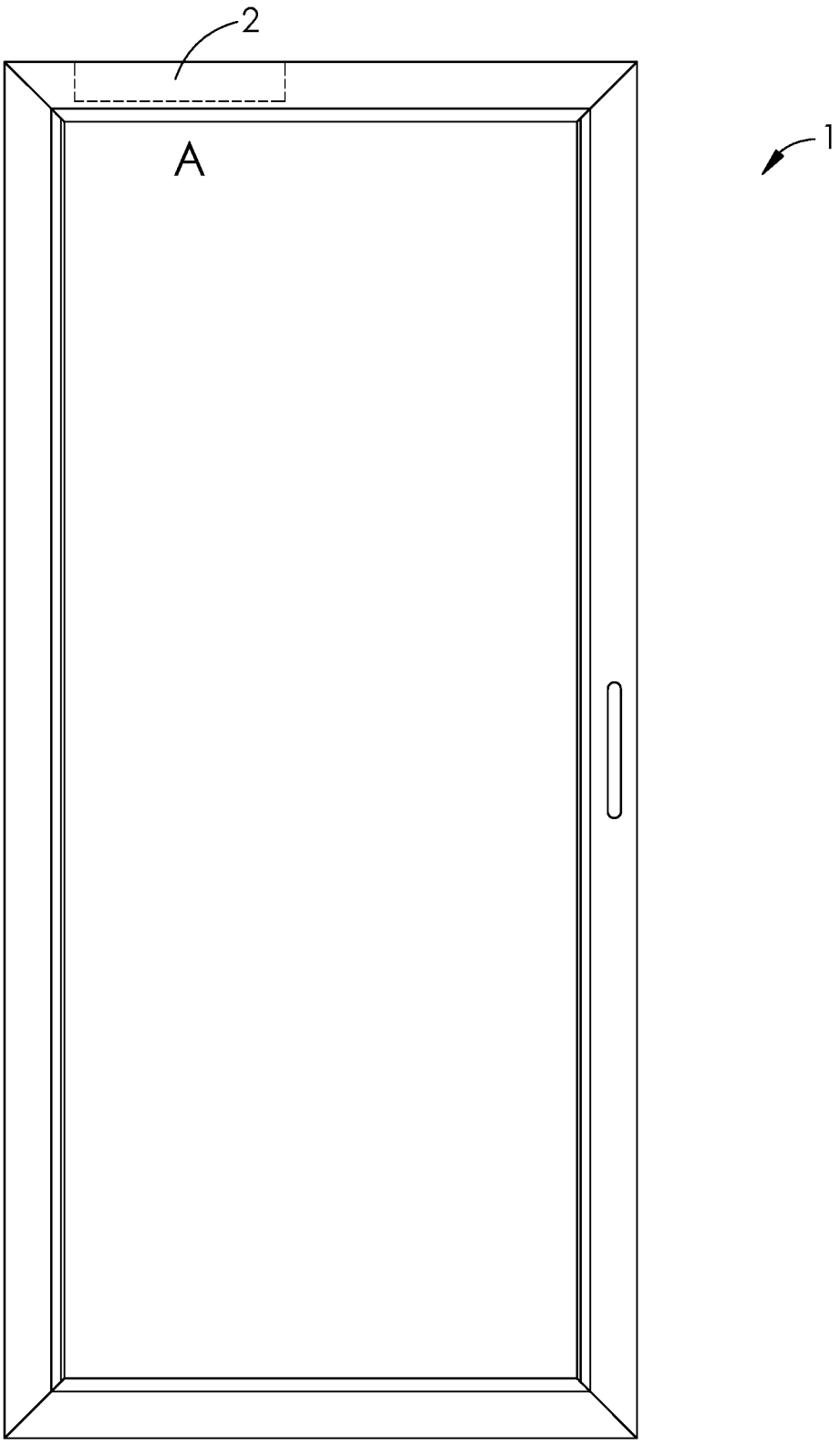
Figure 1F:
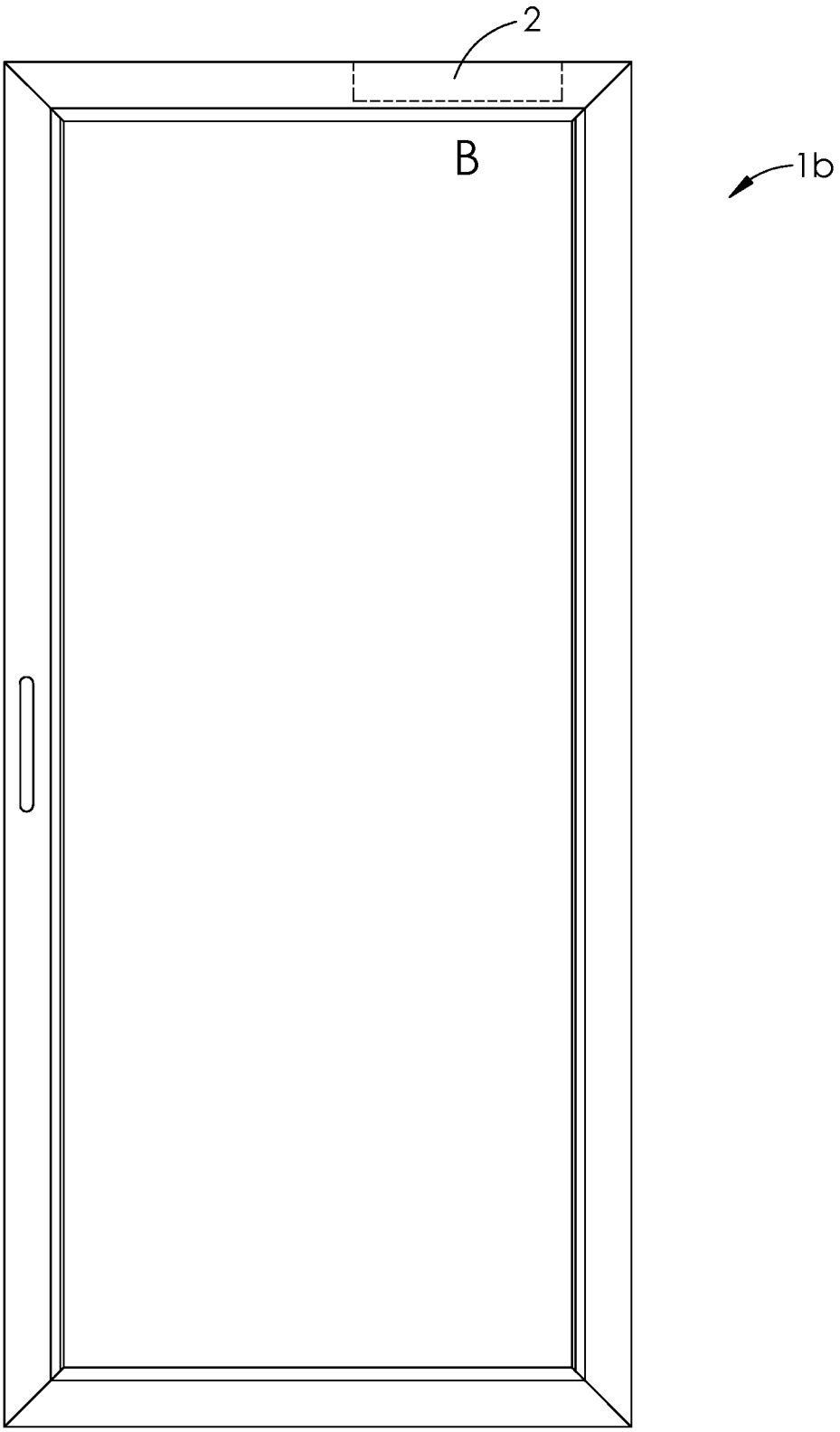

FIGS. 1E and 1F illustrate embodiments of either a dedicated or sole left hinge door 1 or a dedicated or sole right hinge door 1*b*. In these two embodiments, the door assembly has a single closer pocket, either A 2 in FIG. 1E or B 2 in FIG. 1F, in the upper rail, as well as either a dedicated or sole vertical latch stile for either a left hand or a right hand latch mechanism. One skilled in the art would recognize that the embodiments illustrated in FIG. 1E and FIG. 1F will include the additional door components described in detail for FIGS. 1A-1D.

Figure 1G:
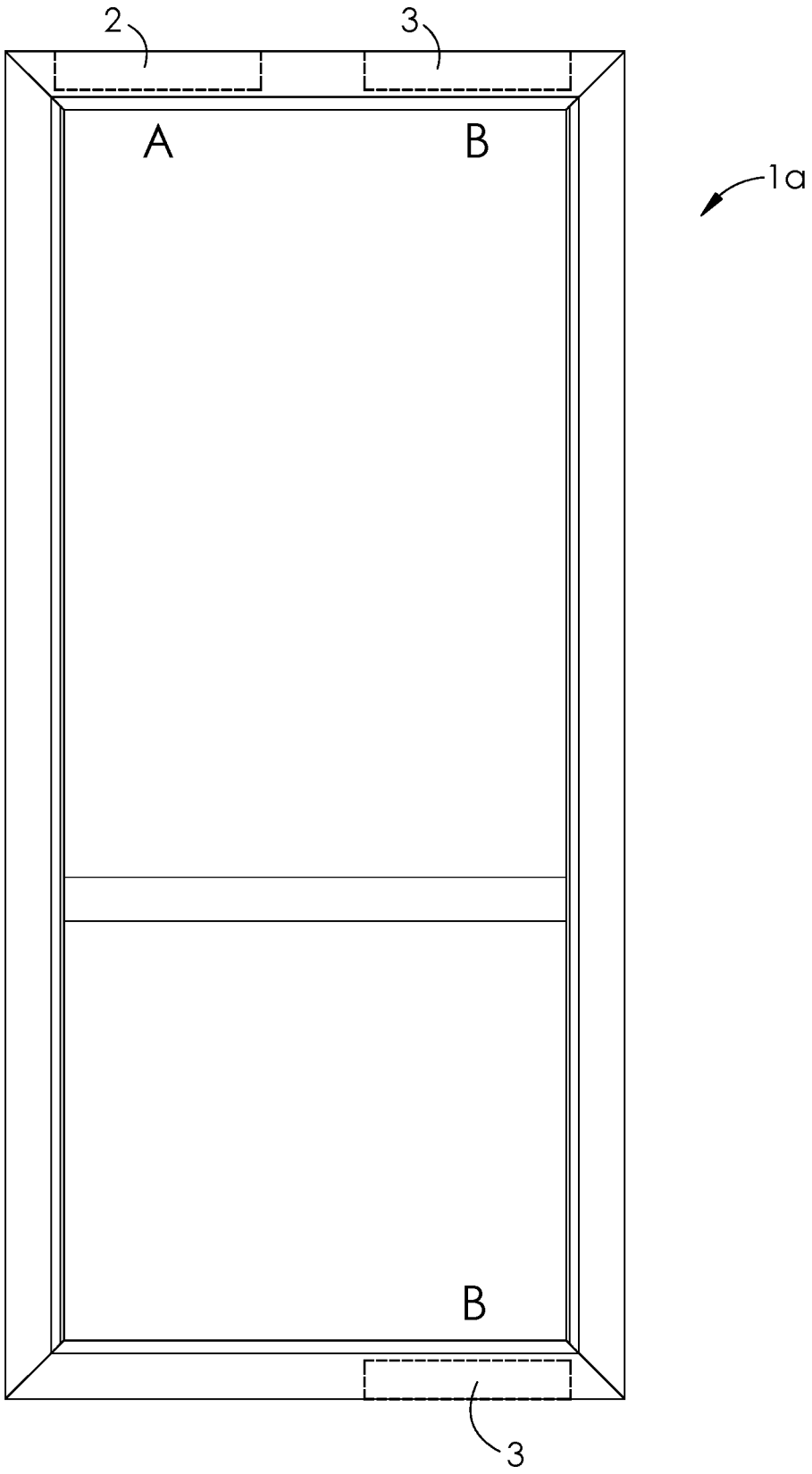

FIG. 1G illustrates an embodiment of a door assembly 1*a* having two closer pockets A 2 and B 3 located in regions of the upper horizontal rail adjacent to the vertical latch and hinge stiles, and the lower horizontal rail optionally having one closer pocket B 3 adjacent to a hinge vertical hinge stile.

Figure 2:
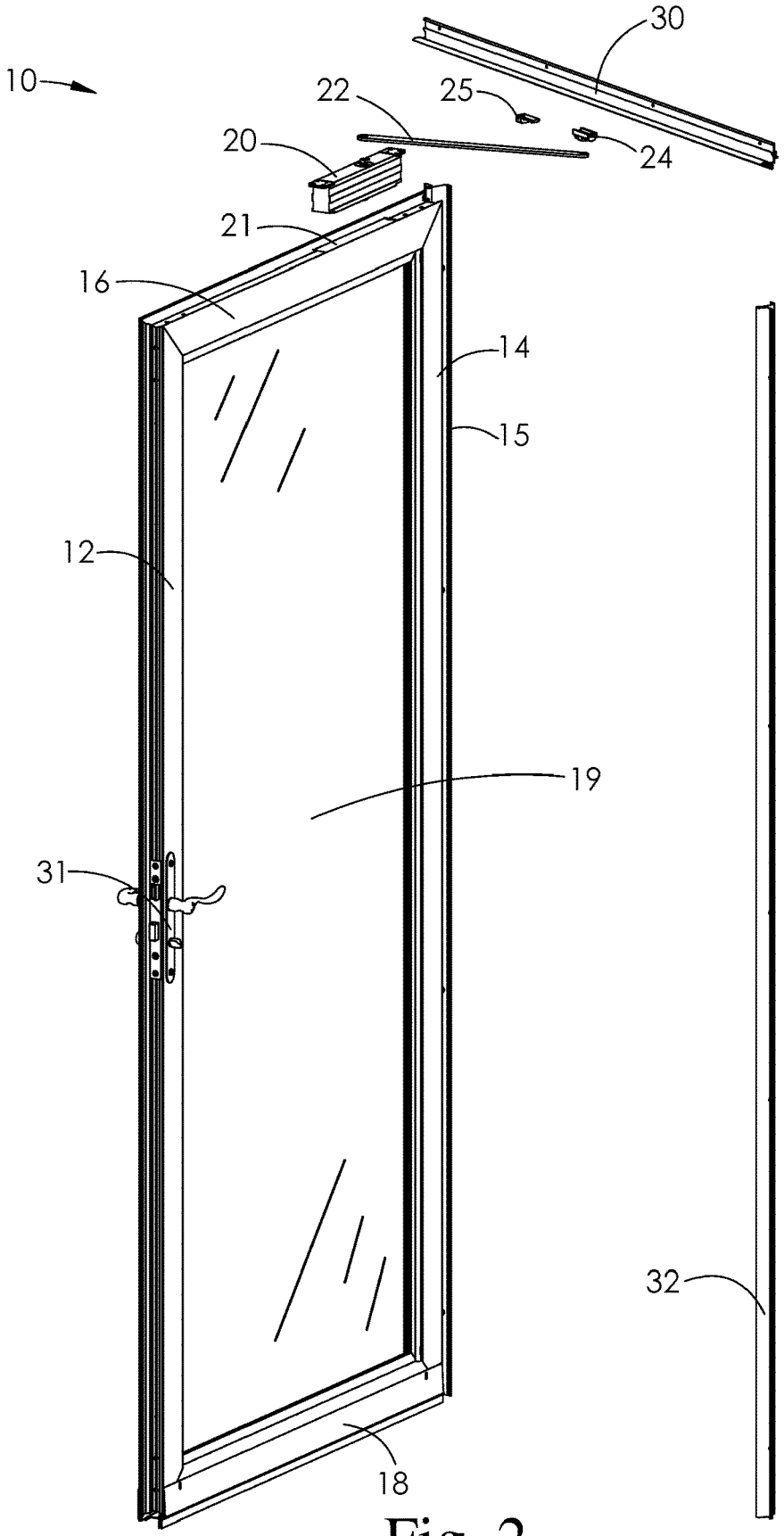
FIG. 2 is an exploded perspective exterior view of a partially-opened door assembly including a door frame, lock set, closer, closer arm, drip cap, hinge frame and latch frame.

FIG. 2 illustrates one embodiment of a left hand hinged door assembly. FIG. 2 includes a left hand hinged door assembly 10 having a vertical latch stile 12, a vertical hinge stile 14 and vertical hinge frame 15, upper horizontal rail 16 and lower horizontal rail 18. This door assembly is directed to a full view door that includes an opening defined by the two vertical stiles and the two horizontal rails. The rails and stiles may serve as a frame for a screen or window insert, or both, and in use the opening may be fitted with window insert 19, or alternatively a screen insert (not shown). Other door assembly components illustrated in FIG. 1 include closer 20, upper rail pocket 21, closer arm 22, sliding attachment fixture 24, and drip cap 30. In use, the closer 20 provides a force to closer arm 22 to move the hinged door frame from an opened position to a closed position as the closer arm moves the sliding attachment fixture 24 in a slide track (not shown) associated with the drip cap 30. FIG. 1 further illustrates an internal latch mechanism 31 attached to vertical latch stile 12. This latch mechanism latches the door in a closed position when the latch components mate with optional fixtures (not shown) on vertical latch frame 40 which is attached to the adjacent door jamb of the framed door opening (not shown).

Figure 3A:
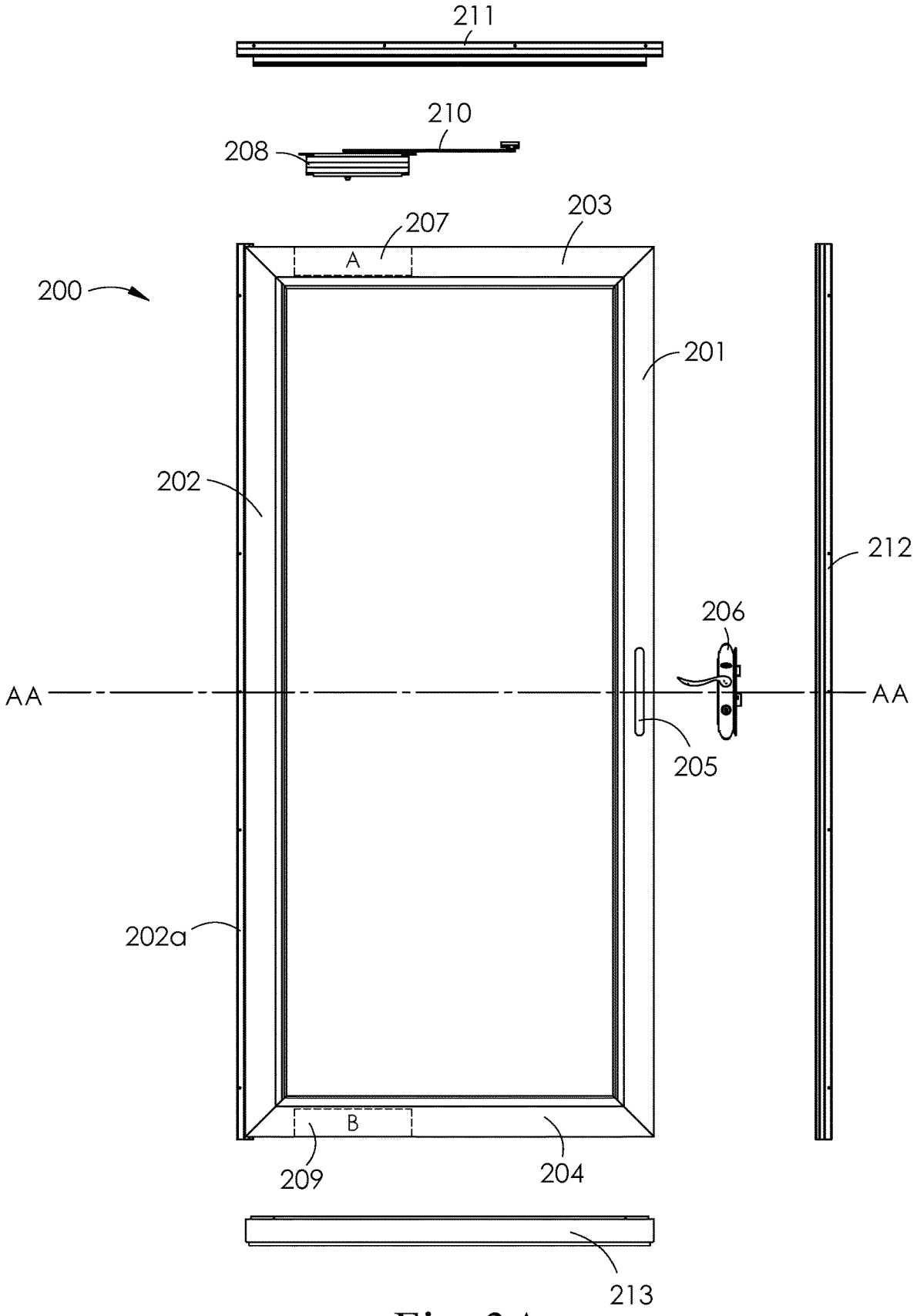
FIGS. 3A and 3B are exploded front exterior views of a left hinged door assembly (3A) and a right hinged door assembly (3B). Each door assembly in FIGS. 3A and 3B includes a door frame, closer, drip cap, lock set, vertical hinge frame, vertical latch frame and lower rail expander.
Figure 3B:
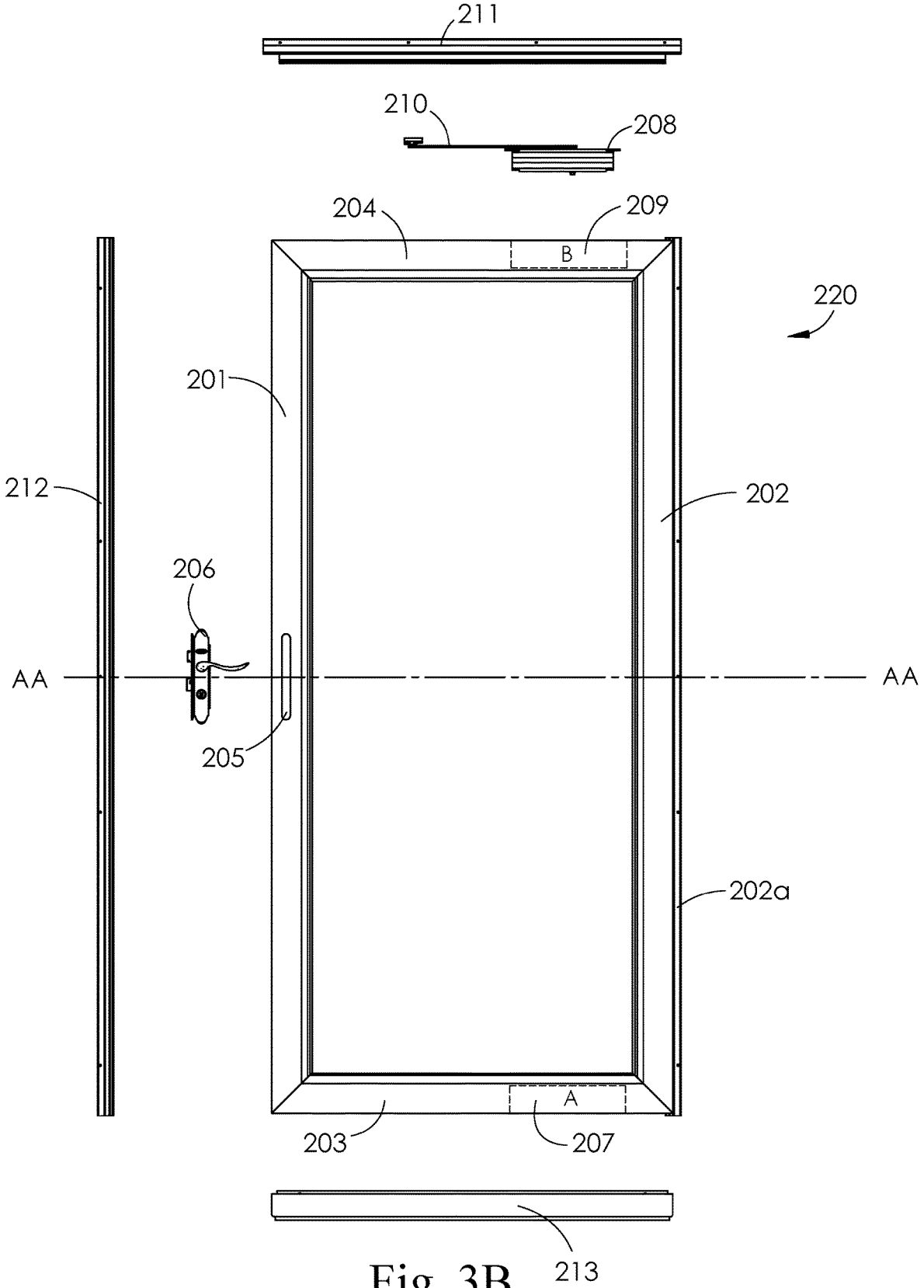

FIGS. 3A and 3B illustrate an embodiment of a door assembly that may be installed as either a left hinged or a right hinged door. The door assembly components in FIG. 3A include left hinged door assembly 200 having vertical latch stile 201, vertical hinge stile 202 and vertical hinge frame 202*a*, upper horizontal rail 203 and lower horizontal rail 204. In this embodiment, vertical latch stile 201 includes a latch mechanism pocket 205 for fitting latch mechanism 206 to the latch stile. In addition, upper rail 203 includes a closer pocket 207 adjacent to hinge stile 202 for fitting closer 208 to the upper rail. Another pocket 209 is included in lower rail 204. This pocket is used to fit or house a closer to this rail when door assembly 200 is used for a right hinged door as described below. Other door assembly components illustrated in FIG. 3A include closer arm 210 which in use moves the door frame from an open position to a closed position as described above and drip cap 211. FIG. 3A also illustrates vertical latch frame 212 and expander 213. Vertical latch frame 212 combines with latch mechanism 206 to latch and/or securely lock the door in a closed position. Expander 213 may be fitted to the lower rail to adjust the bottom of the door frame to provide a desired seal between the door and the door threshold of the framed door opening and to conceal unused pocket 209.

The door assembly components in FIG. 3B generally correspond to the components of FIG. 3A, except that the door assembly is configured as a right hinged door. This right hinged configuration is readily accomplished because the door assembly components are substantially symmetrical about the AA-AA section line illustrated in FIG. 3A. Those skilled in the art will readily recognize that the left hinged door assembly of FIG. 3A has been rotated 180° from top to bottom for installation as a right hinged door. In FIG. 3B, components that correspond directly to components illustrated in FIG. 3A are given the same reference numerals. Briefly, the door assembly components in FIG. 3B include right hinged door assembly 220 having vertical latch stile 201, vertical hinge stile 202 and vertical hinge frame 202*a*, upper horizontal rail 204 and lower horizontal rail 203. In this embodiment, vertical latch stile 201 includes a latch mechanism pocket 205 for fitting latch mechanism 206 to the latch stile. In addition, upper rail 204 includes a closer pocket 209 adjacent to hinge stile 202 for fitting closer 208 to the upper rail. Another pocket 207 is included in lower rail 203. This lower pocket was used in the left hinged door assembly 200 configuration to fit or house the closer but is not used when door frame 220 is used for a right hinged door. The other door assembly components illustrated in FIG. 3B include closer arm 210 which in use moves the door frame from an open position to a closed position as described above and drip cap 211. FIG. 3B also illustrates vertical latch frame 212 and expander 213. Vertical latch frame 212 combines with latch mechanism 206 to latch and/or securely lock the door in a closed position. Expander 213 may be fitted to the lower rail to adjust the bottom of the door to provide a desired seal between the door and the door threshold of the framed door opening and to conceal unused pocket 207.

One skilled in the art would readily recognize that alternate configurations for door assemblies 200 and 220 described in FIGS. 3A and 3B, respectively, are possible. For example, closer 208 and closer arm 210 could be inverted and positioned in closer pockets 209 and 207 in FIGS. 3A and 3B, respectively, at the bottom of the door assemblies instead of at the top of the door assemblies. In addition, a second closer and closer arm could be positioned in closer pockets 209 and 207 in FIGS. 3A and 3B, respectively, at the bottom of the door assemblies.

Figure 4A:
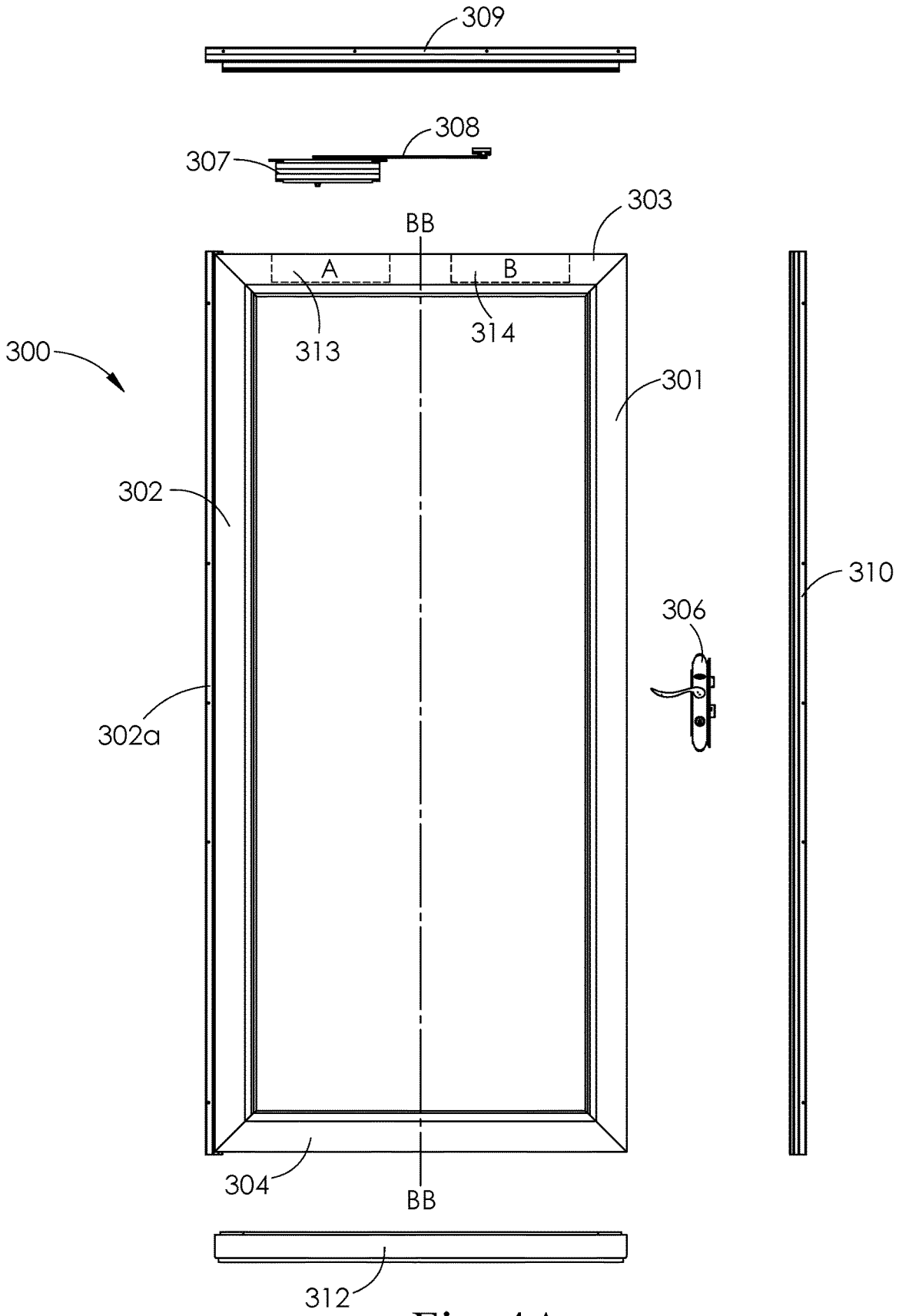
FIGS. 4A and 4B are alternative exploded front exterior views of a left hinged door assembly (4A) and a right hinged door assembly (4B). Each of these door assemblies also includes a door frame, closer, drip cap, lock set, vertical hinge frame, vertical latch frame and bottom expander.
Figure 4B:
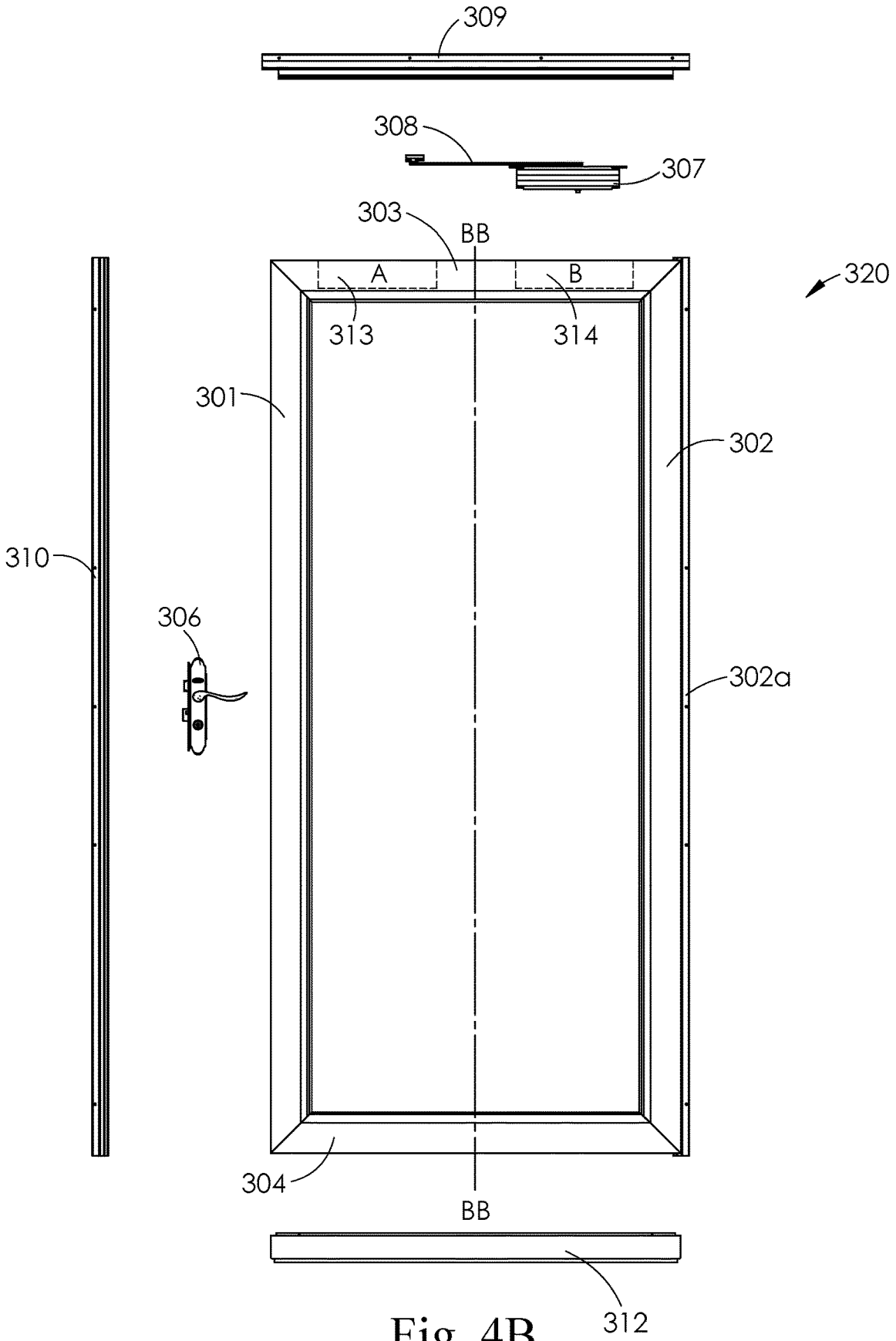

FIGS. 4A and 4B illustrate another embodiment of a door assembly that may also be installed as either a left hinged or a right hinged door. In this illustrated embodiment, the upper horizontal rail includes two pockets 313 and 314 for installing a closer in the upper rail. This embodiment contrasts with the previous embodiment illustrated in FIGS. 3A and 3B having a single pocket in both the upper and the lower horizontal rails. The door assembly components in FIG. 4A include left hinged door assembly 300 having vertical latch stile 301, vertical hinge stile 302 and vertical hinge frame 302*a*, upper horizontal rail 303 and lower horizontal rail 304. In this embodiment, latch mechanism 306 may be externally attached or fitted to vertical latch stile 301, or alternatively the installer may drill or cut appropriate holes or opening in this stile during installation for fitting an internal latch mechanism. In addition, upper rail 303 includes a closer pocket 313 adjacent to hinge stile 302 to fit or house closer 307 to the upper rail. The other closer pocket 314 is not used in this left hinged door configuration. An optional cover (not shown) may be used to close closer pocket 314 when the door is installed. Other door assembly components illustrated in FIG. 4A include closer arm 308 which in use moves the door frame from an open position to a closed position and drip cap 309. FIG. 4A also illustrates vertical latch frame 310 and expander 312. Vertical latch frame 310 combines with latch mechanism 306 to latch and/or securely lock the door during use. Expander 312 may be fitted to the lower rail to adjust the bottom of the door to provide a desired seal between the door and the door threshold of the framed door opening.

The door assembly components in FIG. 4B generally correspond to the components of FIG. 4A, except that the door assembly is configured to a right hinged door. The conversion is readily accomplished because the components are substantially symmetrical about the BB-BB section line illustrated in FIG. 4A. In FIG. 4B, components that correspond directly to components illustrated in FIG. 4A are numbered the same. Briefly, the door assembly components in FIG. 4B include right hinged door assembly 320 having vertical latch stile 301, vertical hinge stile 302 and vertical hinge frame 302*a*, upper horizontal rail 303 and lower horizontal rail 304. In this embodiment, latch mechanism 306 may be externally attached or fitted to vertical latch stile 301, or alternatively the installer may drill or cut appropriate holes or opening in this stile during installation for fitting an internal latch mechanism. In addition, upper rail 303 includes a closer pocket 314 adjacent to hinge stile 302 to fit or house closer 307 to the upper rail. The other closer pocket 313 in not used in this right hinged door configuration. An optional cover (not shown) may be used to close closer pocket 313 when the door is installed. The other door assembly components illustrated in FIG. 4B include closer arm 308 which in use moves the door frame from an open position to a closed position and drip cap 309. FIG. 4B also illustrates vertical latch frame 310 and expander 312. Vertical latch frame 310 combines with latch mechanism 306 to latch and/or securely lock the door during use. Expander 312 may be fitted to the lower rail to adjust the bottom of the door to provide a desired seal between the door and the door threshold of the framed door opening.

Figure 5A:
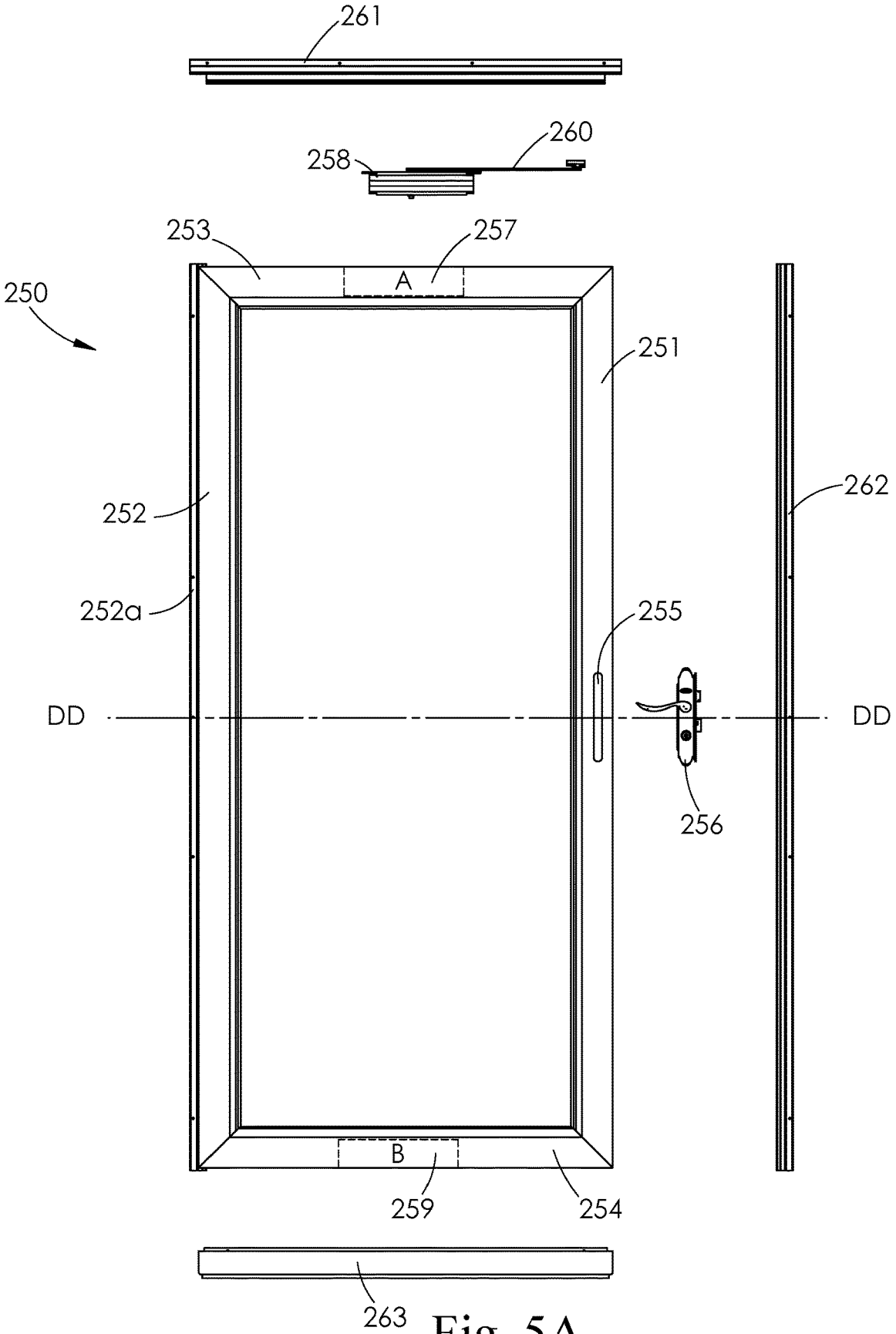
FIGS. 5A and 5B are exploded front exterior views of a left hinged door and a right hinged door with centered pockets in the upper and lower rails.
Figure 5B:
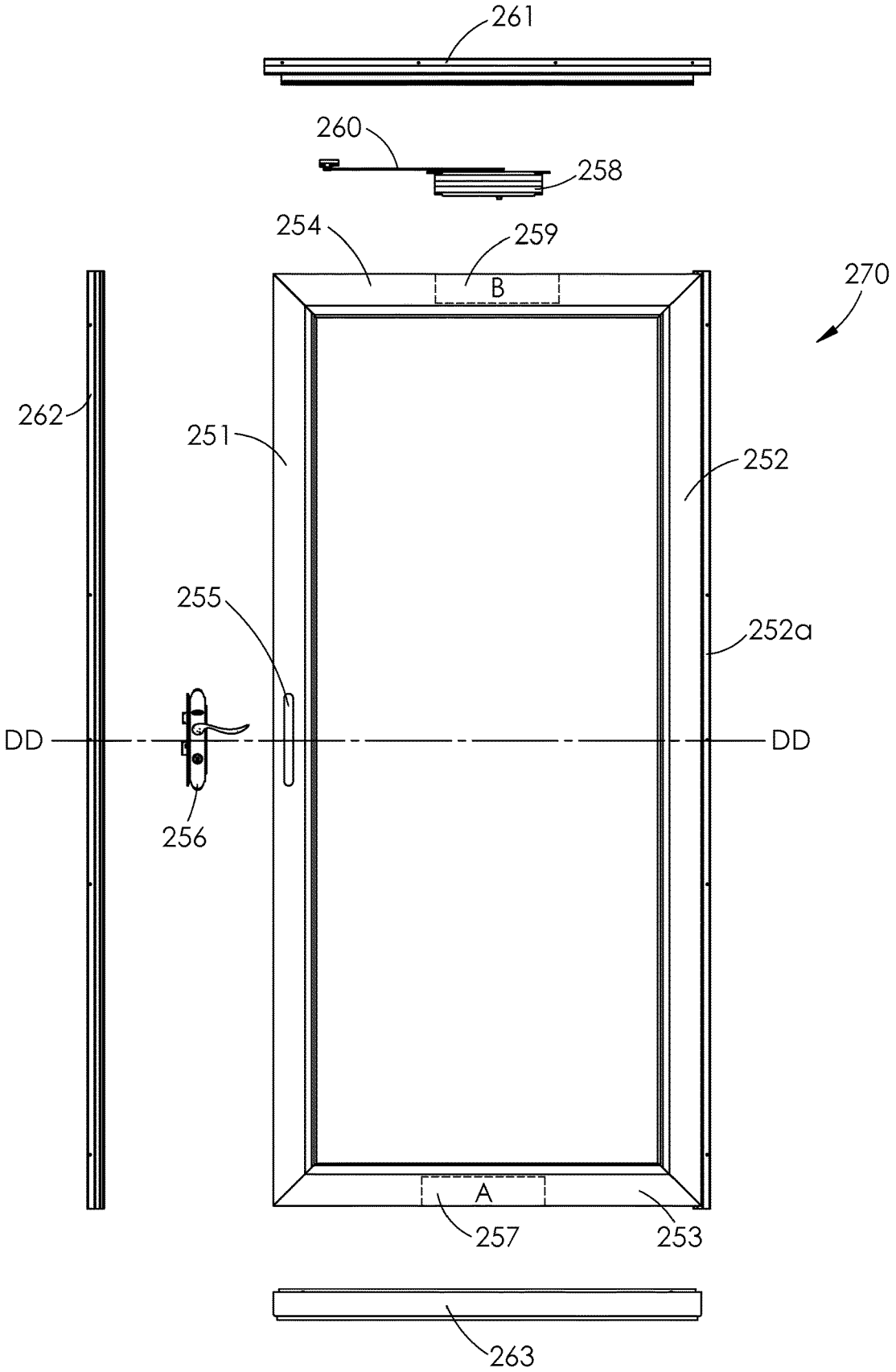

FIGS. 5A and 5B illustrate an embodiment of a door assembly that may be installed as either a left hinged or a right hinged door. The door assembly components in FIG. 5A include left hinged door assembly 250 having vertical latch stile 251, vertical hinge stile 252 and vertical hinge frame 252*a*, upper horizontal rail 253 and lower horizontal rail 254. In this embodiment, vertical latch stile includes a latch mechanism pocket 255 for fitting latch mechanism 256 to the latch stile. In addition, upper rail 253 includes a closer pocket 257 in the center region of the upper rail between the latch stile 251 and the hinge stile 252 for fitting or housing door closer 258 to the upper rail. Another centered pocket 259 is included in lower rail 254. This pocket is used to fit a closer 258 to this rail when door assembly is used for a right hinged door as described below. Other door assembly components illustrated in FIG. 5A include closer arm 260 which in use moves the door assembly from an open position to a closed position as described above and drip cap 261. FIG. 5A also illustrates vertical latch frame 262 and expander 263. Vertical latch frame 262 combines with latch mechanism to latch and/or securely lock the door in closed position. Expander 263 may be fitted to the lower rail to adjust the bottom of the door frame to provide a desired seal between the door and the door threshold of the framed door opening and to cover unused closer pocket 259.

The door assembly components in FIG. 5B generally correspond to the components of FIG. 5A, except that the door assembly is configured as a right hinged door. The change from a left hinged configuration to a right hand configuration is readily accomplished because the components are substantially symmetrical about the DD-DD section line illustrated in FIG. 5A. One skilled in the art would understand that the door assembly has been rotated 180° from top to bottom to change the left hinged configuration to the right hand configuration. Briefly, the door assembly components in FIG. 5B include right hinged door assembly 270 having vertical latch stile 251, vertical hinge stile 252 and vertical hinge frame 252*a*, upper horizontal rail 254 and lower horizontal rail 253 (door assembly components that are the same in FIGS. 5A and 5B are identified with the same reference numerals). In this embodiment, vertical latch stile 251 includes a latch mechanism pocket 255 for fitting latch mechanism 256 to the latch stile. In addition, upper rail 254 includes a closer pocket 259 in a centered region of the upper rail between the vertical latch stile 251 and the hinge stile 252 for fitting or housing closer 258 to the upper rail. Another pocket 257 is included in lower rail 253. This lower pocket was used in the left hinged door frame 250 configuration to include the closer but is not used when door assembly 270 is used for a right hinged door. The other door assembly components illustrated in FIG. 5B include closer arm 260 which in use moves the door frame from an open position to a closed position as described above and drip cap 261. FIG. 5B also illustrates vertical latch frame 262 and expander 263. Vertical latch frame 262 combines with latch mechanism 256 to latch and/or securely lock the door in a closed position. Expander 263 may be fitted to the lower rail to adjust the bottom of the door to provide a desired seal between the door and the door threshold of the framed door opening and to cover unused closer pocket 257.

Figure 6A:
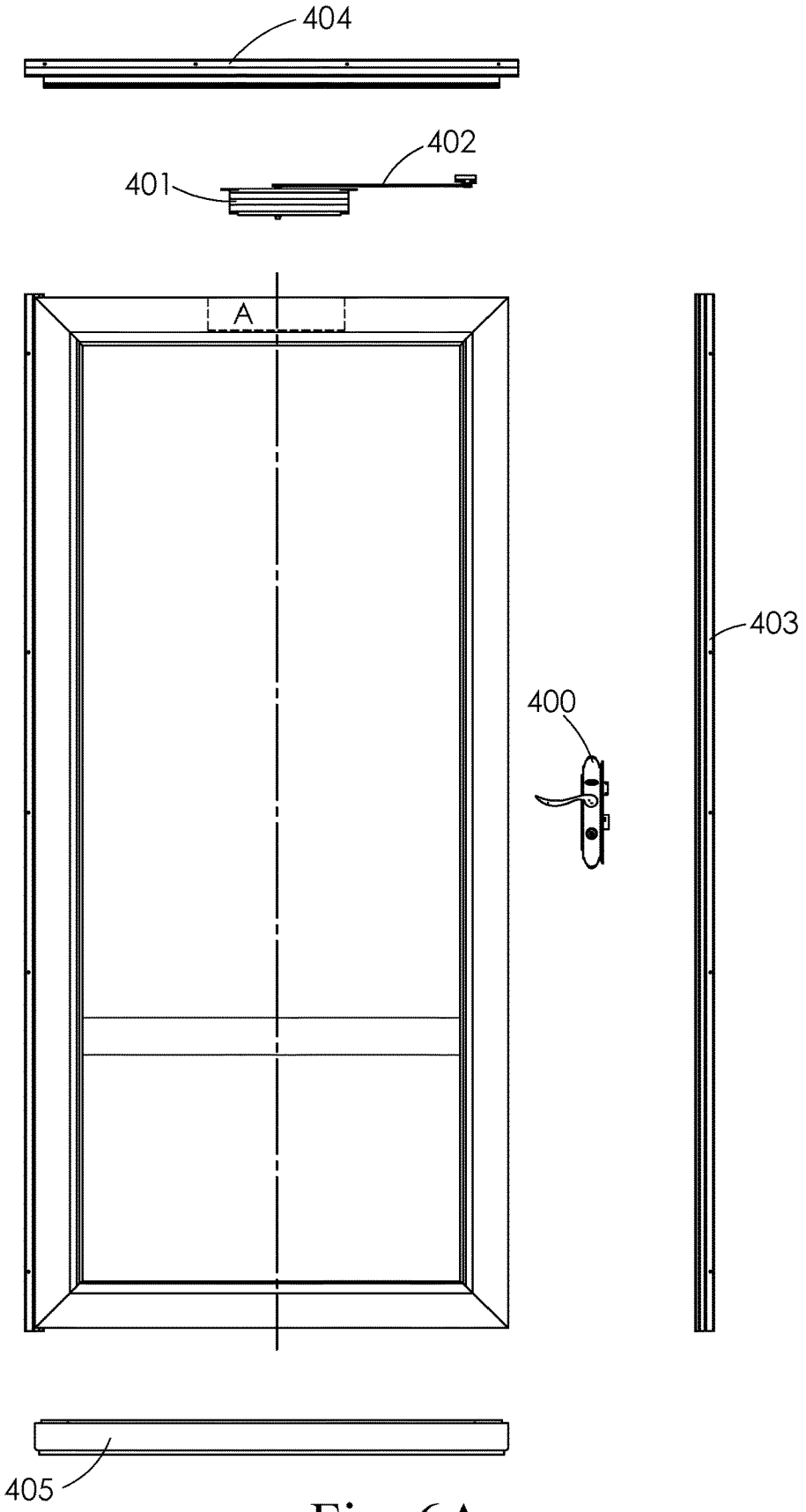
FIGS. 6A and 6B are exploded front exterior views of a left hinged and right hinged door with a single centered pocket in the upper rail.
Figure 6B:
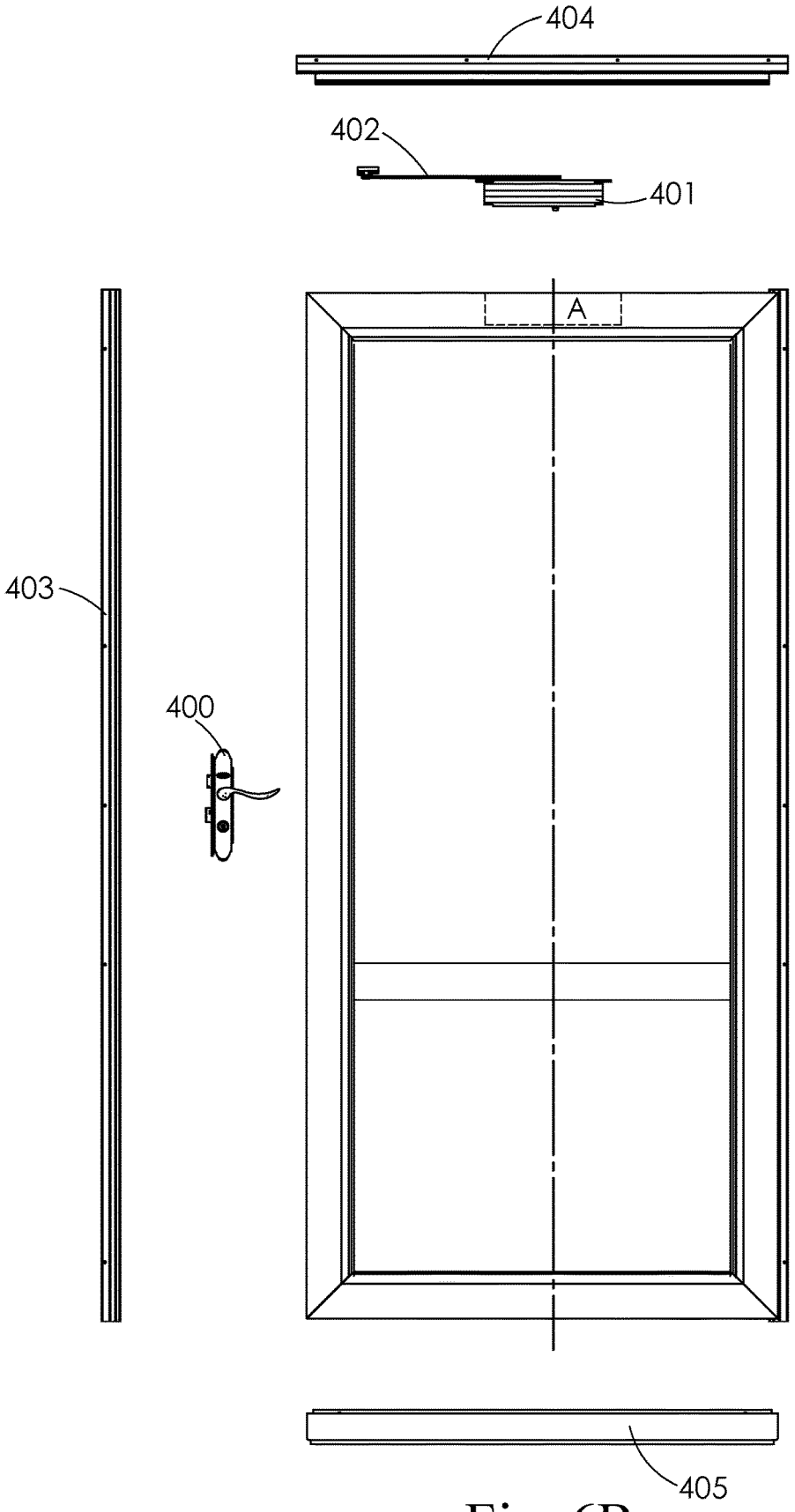

FIGS. 6A and 6B further illustrate left hinged and right hinged door assemblies set out in FIG. 1D that illustrated a door assembly that includes a single closer pocket A in the upper rail of the door frame. The door assembly components illustrated in FIGS. 6A and 6B include latch mechanism 400, door closer 401 and closer arm 402, vertical latch frame 403, drip cap 404 and expander 405. The door closer 401 may be configured to have the vertical pinion centered in the closer body or, alternatively, the closer body may be configured to have the vertical pinion of the closer offset in the closer body so that the closer arm is attached or connected to the door closer offset from the centerline of the door frame nearer to the left hand or right hand hinge stile. The offset toward the left or right hand side hinge stile prevents the door closer, closer arm and sliding attachment fixture from binding as the door is opened and closed. A latch mechanism 400 is then attached or fitted to the right or left hand side stile. In either of the embodiments of FIG. 6A or 6B latch cutouts can be made in the field at the installation site if an internal latch mechanism, as compared to an external latch mechanism, is desired. In this embodiment, the door assembly is symmetrical about a vertical axis, and an installer would understand or be instructed to configure the door assembly in order to allow either a left hinged or a right hinged installation of this door assembly.

Figure 6C:
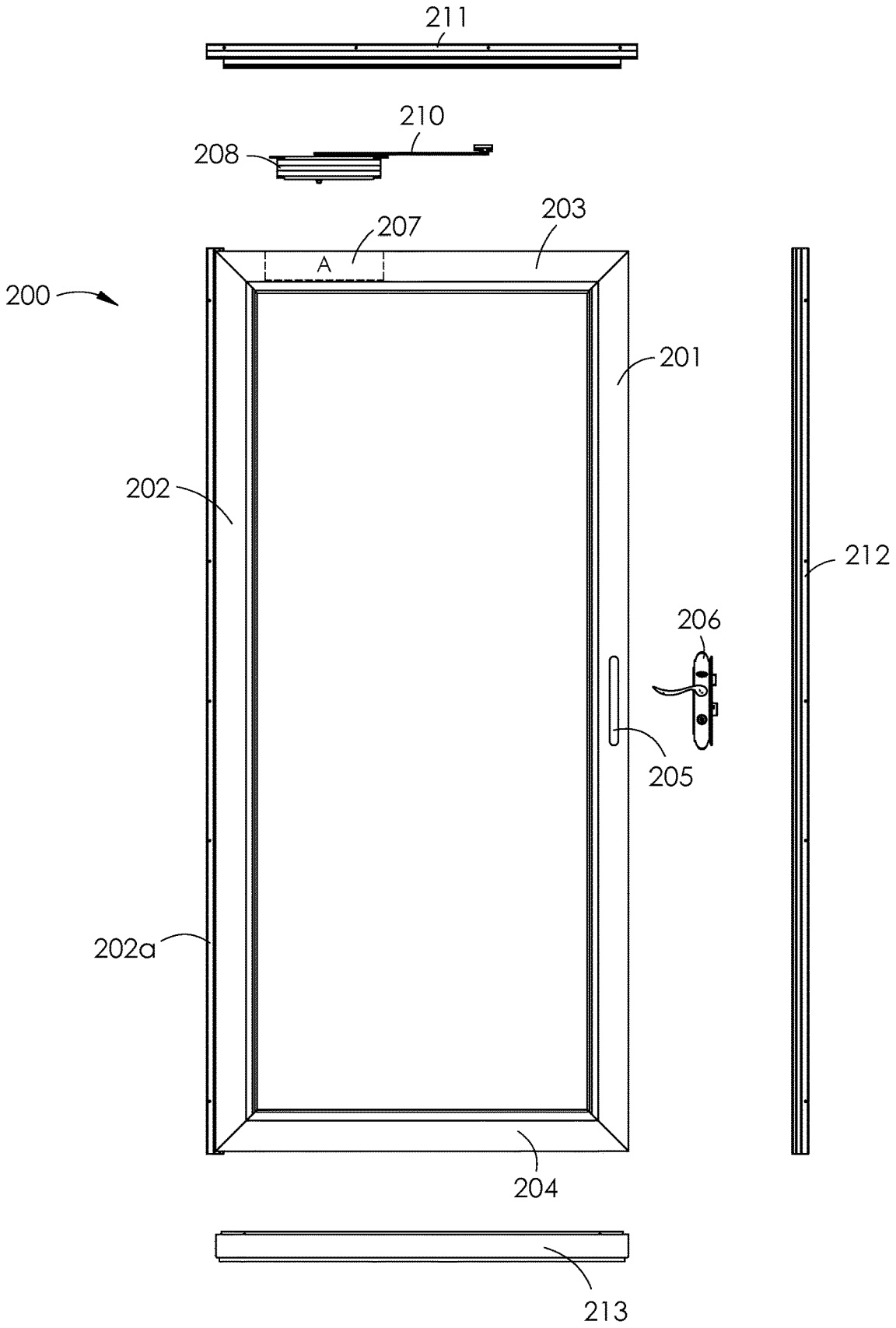
FIGS. 6C and 6D are exploded front exterior views of a left hinged and right hinged door with a single pocket in the hinged side of the upper rail.
Figure 6D:
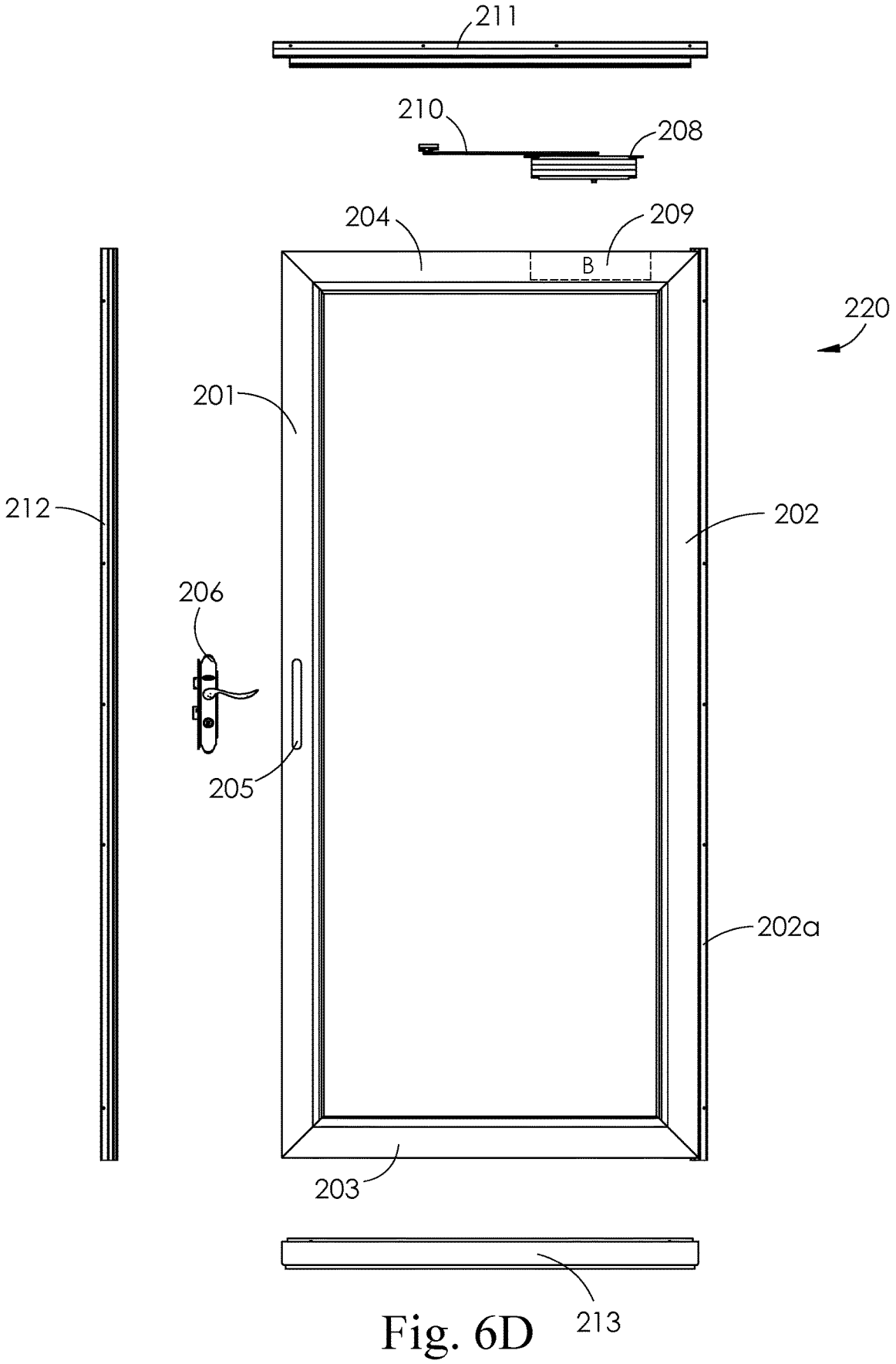

FIGS. 6C and 6D illustrate two embodiments of a door assembly, the first of which may be installed as a left hinged door and the second of which may be installed as a right hinged door. The door assembly components in FIG. 6C include left hinged door assembly 200 having vertical latch stile 201, vertical hinge stile 202 and vertical hinge frame 202*a*, upper horizontal rail 203 and lower horizontal rail 204. In this embodiment, vertical latch stile 201 includes a latch mechanism pocket 205 for fitting latch mechanism 206 to the latch stile. In addition, upper rail 203 includes a closer pocket 207 adjacent to hinge stile 202 for fitting closer 208 to the upper rail. Other door assembly components illustrated in FIG. 6C include closer arm 210 which in use moves the door frame from an open position to a closed position as described above and drip cap 211. FIG. 6C also illustrates vertical latch frame 212 and expander 213. Vertical latch frame 212 combines with latch mechanism 206 to latch and/or securely lock the door in a closed position. Expander 213 may be fitted to the lower rail to adjust the bottom of the door frame to provide a desired seal between the door and the door threshold of the framed door opening.

The door assembly components in FIG. 6D generally correspond to the components of FIG. 6C, except that the door assembly is configured to be used only as a right hinged door. In FIG. 6D, components that correspond directly to components illustrated in FIG. 6C are given the same reference numerals. Briefly, the door assembly components in FIG. 6D include right hinged door assembly 220 having vertical latch stile 201, vertical hinge stile 202 and vertical hinge frame 202*a*, upper horizontal rail 204 and lower horizontal rail 203. In this embodiment, vertical latch stile 201 includes a latch mechanism pocket 205 for fitting latch mechanism 206 to the latch stile. In addition, upper rail 204 includes a closer pocket 209 adjacent to hinge stile 202 for fitting closer 208 to the upper rail. The other door assembly components illustrated in FIG. 6D include closer arm 210 which in use moves the door frame from an open position to a closed position as described above and drip cap 211. FIG. 6D also illustrates vertical latch frame 212 and expander 213. Vertical latch frame 212 combines with latch mechanism 206 to latch and/or securely lock the door in a closed position. Expander 213 may be fitted to the lower rail to adjust the bottom of the door to provide a desired seal between the door and the door threshold of the framed door opening.

One skilled in the art would readily recognize that alternate configurations for doors 200 and 220 described in FIGS. 6C and 6D, respectively, are possible. For example, closer pockets 207 and 209 could be positioned in lower horizontal rails 204 and 203, respectively, adjacent to hinge stile 202 such that closer 208 and closer arm 210 are inverted and positioned at the bottom of the door instead of at the top of the door.

Figure 7A:
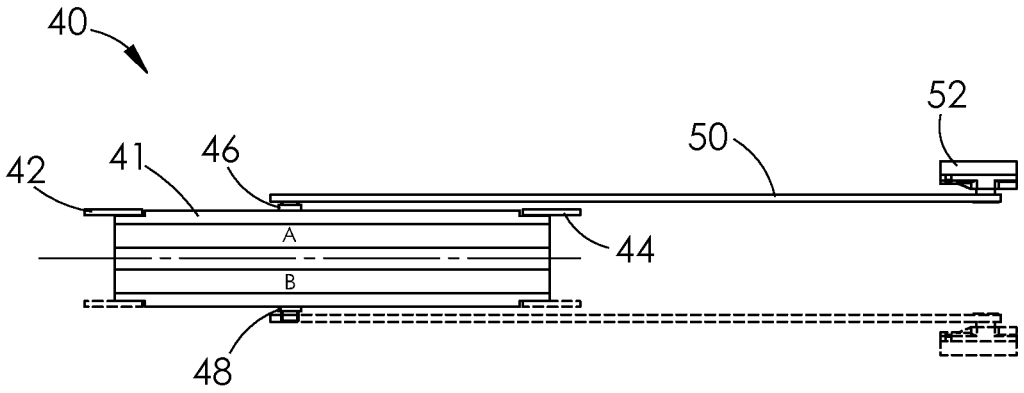
FIGS. 7A and 7B are front views of a left hinged door closer and closer arm and a right hinged door closer and closer arm.
Figure 7B:
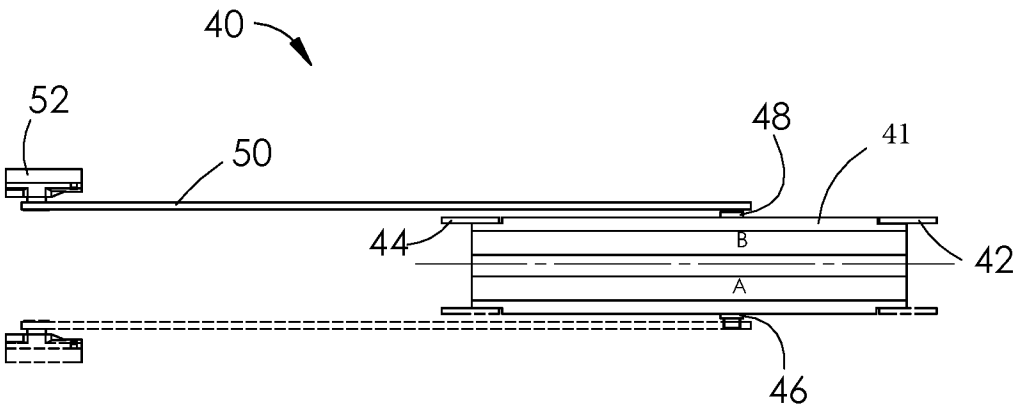

FIGS. 7A and 7B illustrate a closer 40 that may be used in both a left hinged or right hinged door. This illustrated closer 40, for example, may be used with the door assemblies illustrated in FIG. 3A, 3B, 4A, 4B, 5A, 5B, 6A, 6B, 6C or 6D. The closer in FIGS. 7A and 7B has a closer body 41, a set of mounting tabs 42 and 44, and upper and lower connecting studs 46 and 48. FIGS. 7A and 7B also illustrate closer arm 50 and slide attachment fixture 52. In use, mounting tabs 42 and 44 attach the closer body to an upper horizontal rail. Connecting studs 46 and 48 are attached to an internal pinion (not shown) in the closer body which provides rotational force to the connecting studs. When the closer arm 50 is attached to one of the connected studs, a rotational force is transmitted to closer arm in order to move the slide attachment fixture 52 in a slide track (not shown) associated with a drip cap. The rotational movement of the closer arm that is linked to the linear movement of the slide attachment fixture in the slide track provides a force to move a door from an opened to closed position when the door is used. The closer 40, closer arm 50 and slide fixture 52 may be used in either a left hinged door or a right hinged door depending on the configuration and orientation of the closer in the pocket in the upper horizontal rail. In particular, when the closer body 41 is attached to the upper rail with mounting tabs 42 and 44 in a pocket adjacent the vertical hinge stile with connecting stud 46 in an upward orientation as shown in FIG. 7A, the closer may be used in a left hinged door. If the closer body is inverted and rotated end-for-end, and then attached to the upper rail with mounting tabs 42 and 44 in a pocket adjacent the vertical hinged stile with connecting stud 48 in an upward orientation as shown in FIG. 7B, the closer may be used in a right hinged door. The two different orientations of the closer 40 for use in either a left or right hinged door are further illustrated by the use of phantoms lines in both figures. The lower phantom lines illustrate the closer arm and slider fixture for the alternative hinged positons. The phantom closer arm and slider attachment fixture illustrated in FIG. 7A set out a configuration of a right hinged door. Similarly, the phantom closer arm and slider fixture illustrated in FIG. 7B set out a configuration for a left hinged door. The specific orientation of the closer body also provides a particular rotation of the pinion and connecting studs. Specifically, when connecting stud 46 is in an upward orientation the connecting stud will rotate in one direction, for example in a clockwise direction. In contrast, when the closer body is inverted and connected stud 48 is in an upward orientation the connecting stud will rotate in the opposite direction, for example in a counterclockwise direction.

One skilled in the art would readily recognize that alternate configurations for closer 40 are possible. For example, closer 40 could be configured such that connecting studs 46 and 48 are attached to separate internal pinions (not shown), and both extend through the same side of closer body 41, with one pinion and stud configured to rotate in a clockwise direction and the other pinion and stud configured to rotate in a counterclockwise direction. Closer 40, closer arm 50, and slide fixture 52 would be able to be used for both right hinged and left hinged doors by attaching the closer arm 50 to the appropriate connecting stud.

Figure 8:
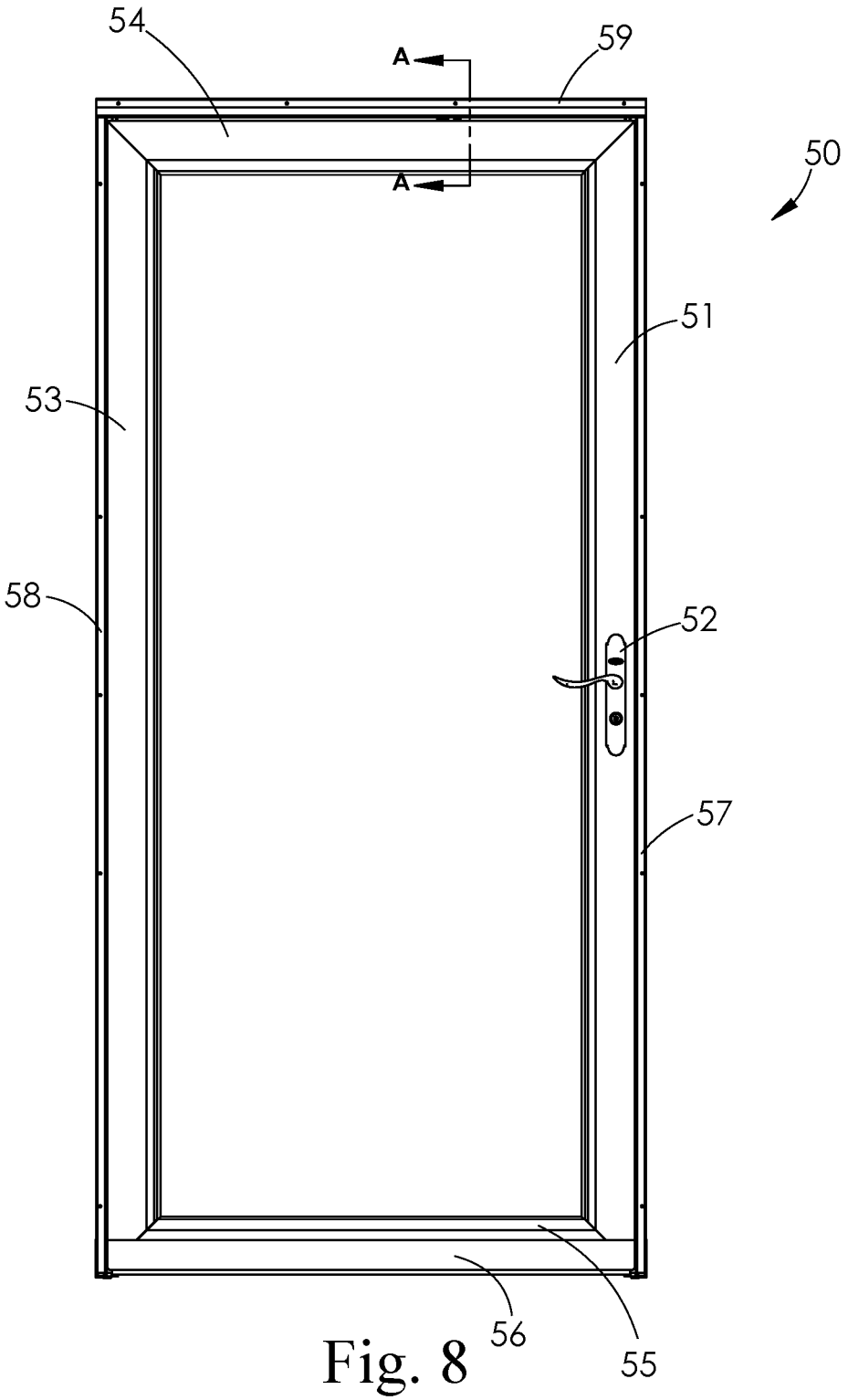
FIG. 8 is a front exterior view of a door that includes A-A section line

FIG. 8 is a front view of a full view door that illustrates another disclosed embodiment of a door assembly. In this embodiment, the door is in a closed position and illustrates the following door assembly components: door assembly 50 having latch stile 51 with mounted latch mechanism 52, hinge stile 53, both stiles attached to upper rail 54 and to lower rail 55 with the lower rail having an attached expander 56, latch frame 57, hinge frame 58 and drip cap 59. When the full view door is in the illustrated closed position the closer and related closer components are hidden or concealed from view on both the internal and external sides of the door.

Figure 9:
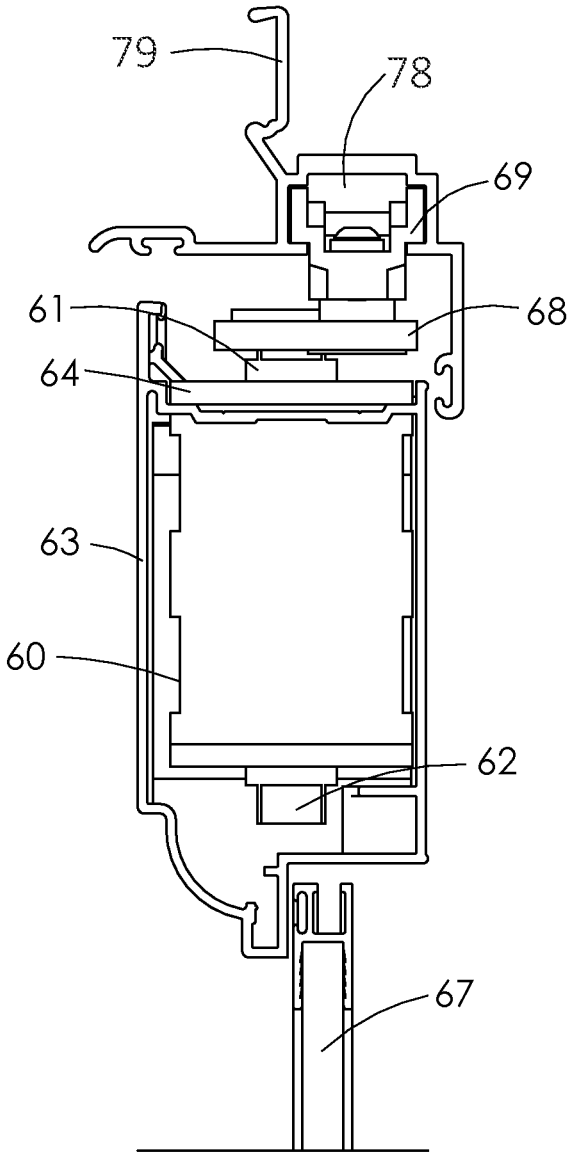
FIG. 9 is a side view taken along section line A-A of the top rail of the door of FIG. 8.

FIG. 9 is a side view of the upper rail 54 of FIG. 8. This side view is a cross section taken along the A-A section line and shows various internal and external components of the door assembly. Closer body 60 having upper and lower connecting studs 61 and 62 is attached to upper rail 63 with mounting tab 64. FIG. 9 also illustrates closer arm 68 attached to connecting stud 61. Closer arm 68 is also attached to slide fixture 69 which is inserted or fitted in an internal slide track 78 of drip cap 79.

Figure 10:
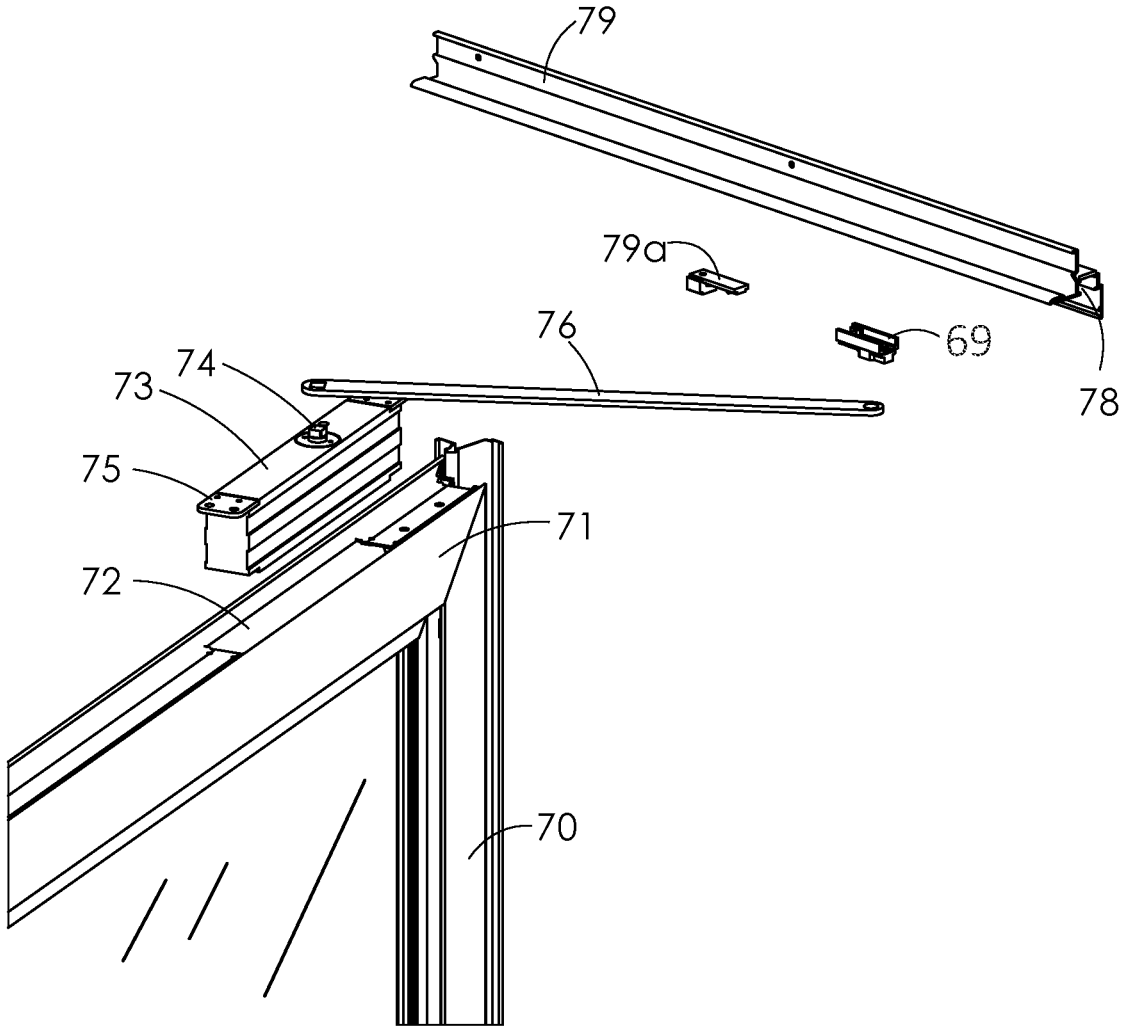
FIG. 10 is an exploded perspective exterior view of a top rail of a door, door closer, closer arm, slide attachment fixture and drip cap.

FIG. 10 is an exploded perspective view of an embodiment of the disclosed door assembly. This perspective view illustrates hinge stile 70 connected to upper rail 71. Upper rail 71 includes a pocket 72 for inserting closer 73 which is attached to the upper rail with mounting tab 75 (the other mounting tab is not visible in this perspective view). Closer 73 includes connecting stud 74 which is attached to closer arm 76. Closer arm 76 is attached to slide fixture 69 which is fitted or inserted into a slide track 78 that is an integral component of drip cap 79. Hold-open stop 79*a* is also fitted or inserted in slide track 78 and functions to limit the door swing when the door is moved to its most open position, and can keep the door in a fixed stay-open position, if desired, and then can be released from the stay-open position for the door to close.

One skilled in the art would readily recognize that alternate configurations for closer arm 76 and slide fixture 69 are possible. For example, while FIG. 10 depicts a closer arm comprised of a single segment, closer arms comprised of two or more linked segments are also possible. Where linked segments are utilized, the segment farthest from connecting stud may be connected to slide fixture 69 which is fitted or inserted into a slide track 78, or may be connected directly to drip cap 79 or the frame of the opening into which the entire door assembly is installed without the use of a slide fixture or slide track.

Figure 11:
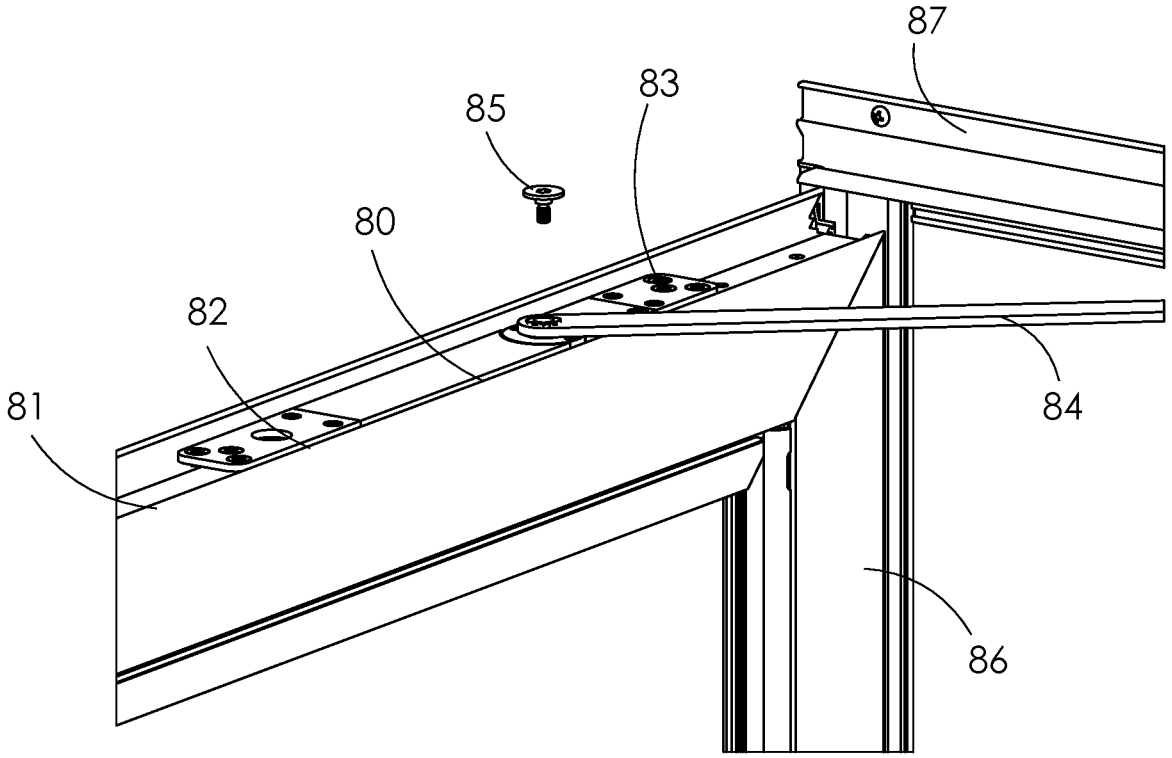
FIG. 11 is a perspective exterior view of a closer arm attached to a closer body inserted into a pocket in an upper rail of a door frame.

FIG. 11 is a perspective view that illustrates closer 80 mounted in the upper rail 81 with mounting tabs 82 and 83. Closer arm 84 is connected to a connecting stud of the closer and secured or held in place with fastener 85. In this perspective view, the closer and closer pocket are adjacent the hinge stile 86 which as attached to a door jamb (not shown) in the framed door opening below drip cap 87.

Figure 12:
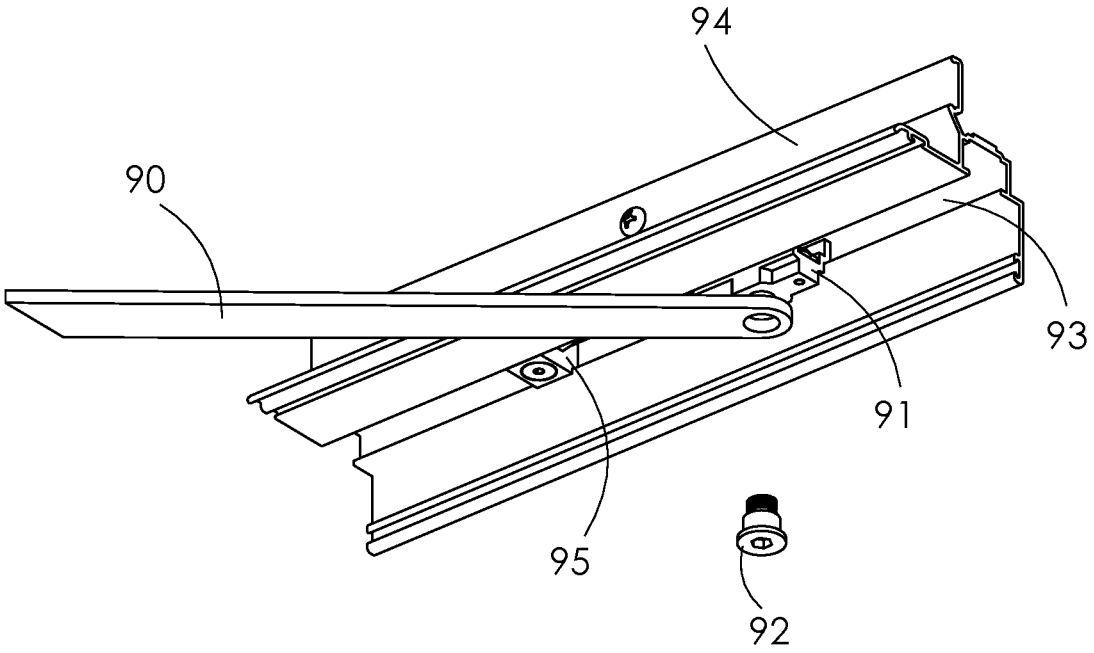
FIG. 12 is a perspective view of a closer arm attached to an integral slide track in a drip cap.

FIG. 12 is a perspective view that illustrates closer arm 90 connected to slide attachment fixture 91. In this figure, slide attachment fixture 91 is secured or held in place to the closer arm 90 with fastener 92. Slider fixture 91 is fitted or inserted into integral slide track 93 in drip cap 94. Hold-open stop 95 is also fitted or inserted into integral slide track 93 to limit the door swing as well as keep the door in a releasable stay-open position.

Figure 13:
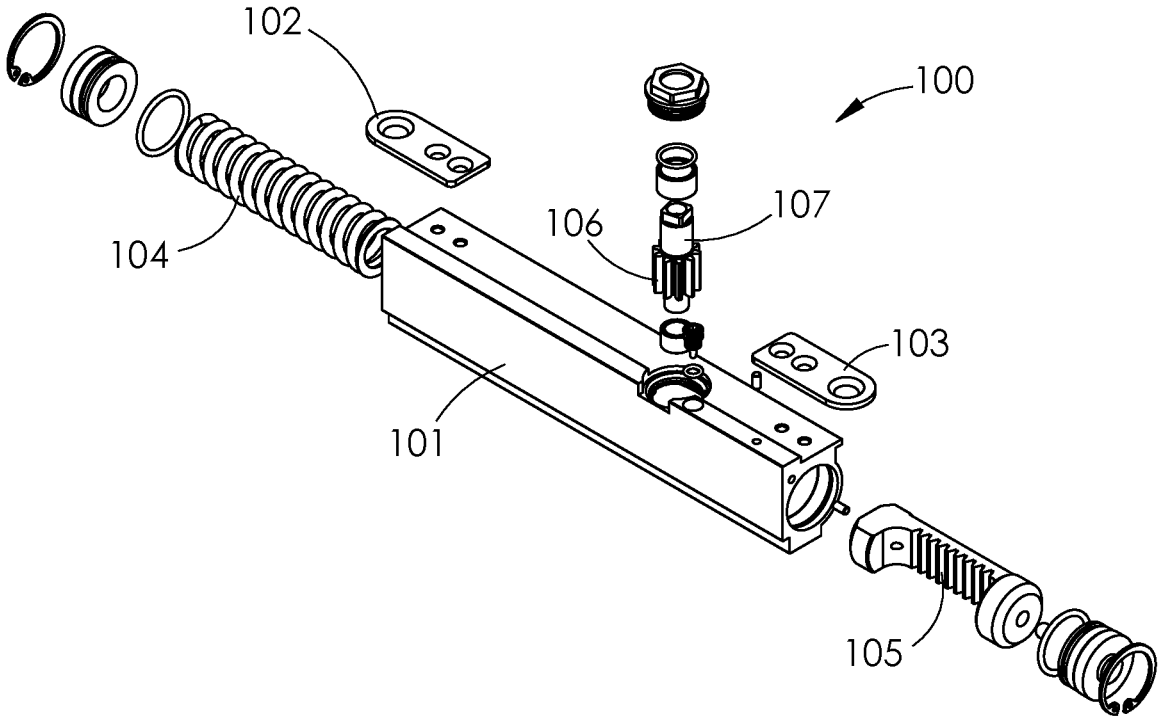
FIG. 13 is an exploded perspective view of an embodiment of a door closer.

FIG. 13 is an exploded perspective view of a mechanical spring closer 100. This closer includes a closer body 101 and mounting tabs 102 and 103. Mechanical biasing spring 104 is fitted in closer body 101 and connected to exert a force on geared rack 105. Geared pinion 106 is rotatably mounted in the closer body and is engaged with the geared rack to provide rotational motion as the rack is moved linearly. Geared pinion 106 includes connecting stud 107 which may be connected to a closer arm (not shown). As the connected closer arm is moved by opening and closing the door assembly (not shown), gear pinion rotates and linearly displaces rack 105. The movement of the rack imparts a compressive force to spring 104. When the door assembly is released from an open position, sufficient force is transferred by the spring through the rack 105 and pinion 106 to the closer arm to move the door frame from the open position to the closed position by the rotation of the geared pinion and the resulting movement of the closer arm.

Figure 14:
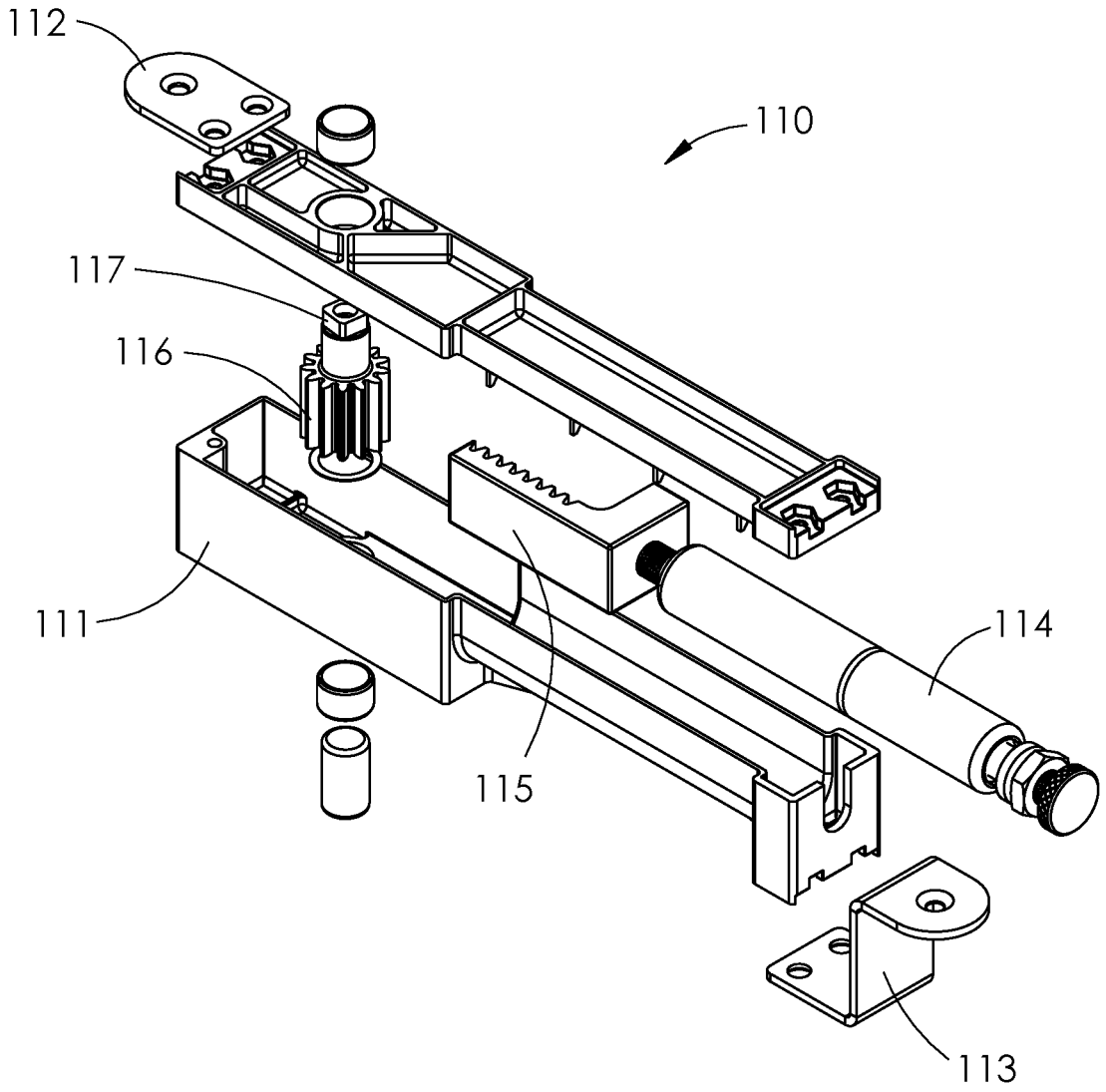
FIG. 14 is an exploded perspective view of an alternative embodiment of a door closer.

FIG. 14 is an exploded perspective view of gas spring closer 110. The components of this embodiment, including closer body 111 and mounting tabs 112 and 113, are substantially similar to the closer illustrated in FIG. 13 with the exception that the mechanical spring of FIG. 13 is replaced with gas spring 114. Gas spring 114 provides a similar force to geared rack 115 and geared pinion 116 as the geared pinion is rotated by the movement of a closer arm (not shown) which is connected to the geared pinion by connecting stud 117.

ALTERNATIVE EMBODIMENTS OF THE DISCLOSED INVENTION

Two Pockets in Upper Rail

1. A first embodiment of a door assembly, comprising:

a door having first and second vertical stiles attached to upper and lower horizontal rails, the upper horizontal rail having two closer pockets located in regions of the upper horizontal rail adjacent to the first and second vertical stiles;

a drip cap having a horizontal body with first and second ends;

a slide track associated with the drip cap and horizontally extending between the first and second ends of the drip cap;

a closer insertable into one of the pockets of the upper horizontal rail comprising a closer body having one or more mounting tabs fastened to the closer body attached to the upper horizontal rail, and a vertical pinion rotatably connected to an internal biasing mechanism and having at least one connecting stud extending through the closer body, wherein the vertical pinion provides sufficient rotational force to move the door from an opened position to a closed position; and a closer arm having an attachment fixture on one end of the closer arm attachable to the vertical pinion connecting stud and a slide fixture on an opposite end of the closer arm insertable into the slide track.

Pocket in both Upper and Lower Rails

2. A second embodiment of a door assembly, comprising:

a door having a vertical latch stile and a vertical hinge stile attached to upper and lower horizontal rails, the upper and lower horizontal rails each having a closer pocket located in a region of the horizontal rail adjacent to the vertical hinge stile;

a drip cap having a horizontal body with first and second ends;

a slide track associated with the drip cap and horizontally extending between the first and second ends of the drip cap;

a closer insertable into the pocket of the upper horizontal rail comprising a closer body having one or more mounting tabs fastened to the top or bottom of the closer body attached to the upper horizontal rail, and a vertical pinion rotatably connected to an internal biasing mechanism and having at least one connecting stud extending through the closer body, wherein the vertical pinion provides sufficient rotational force to move the door from an opened position to a closed position; and a closer arm having an attachment fixture on one end of the closer arm attachable to the vertical pinion connecting stud and a slide fixture on an opposite end of the closer arm insertable into the slide track.

Pocket in Upper Rail for Left or Right Hand Door

3. A third embodiment of a door assembly, comprising:

a door having an optional left or right hand vertical latch stile and an optional right or left vertical hinge stile attached to upper and lower horizontal rails, the upper horizontal rail having a closer pocket located in region of the horizontal rail adjacent to the vertical hinge stile;

a drip cap having a horizontal body with first and second ends;

a slide track associated with the drip cap and horizontally extending between the first and second ends of the drip cap;

a closer insertable into the pocket of the upper horizontal rail comprising a closer body having one or more mounting tabs fastened to the top or bottom of the closer body attached to the upper horizontal rail, and a vertical pinion rotatably connected to an internal biasing mechanism and having at least one connecting stud extending through the closer body, wherein the vertical pinion provides sufficient rotational force to move the door from an opened position to a closed position; and a closer arm having an attachment fixture on one end of the closer arm attachable to the vertical pinion connecting stud and a slide attachment fixture on an opposite end of the closer arm insertable into the slide track.

Pocket in the Center of the Upper Rail

4. A fourth embodiment of a door assembly, comprising:

a door having first and second vertical stiles attached to upper and lower horizontal rails, the upper horizontal rail having first and second ends and a closer pocket located in a center region of the upper horizontal rail between the first and second ends, and the lower horizontal rail having first and second ends and an optional closer pocket located in a center region of the lower horizontal rail between the first and second ends;

a drip cap having a horizontal body with a first end and a second end;

a slide track associated with the drip cap and extending between the first and second ends of the drip cap;

a closer insertable into the pocket of the upper horizontal rail comprising a closer body having one or more mounting tabs fastened to the top or bottom of the closer body attachable to the upper horizontal rail, and a vertical pinion that is rotatably connected to an internal biasing mechanism, and having at least one connecting stud extending through the closer body, wherein the vertical pinion provides sufficient rotational force to move the door from an opened position to a closed position; and a closer arm having an attachment fixture on one end of the closer arm attachable to the vertical pinion connecting studs and a slide attachment fixture on an opposite end of the closer arm insertable into the slide track.

5. The door assembly of embodiments 1-4, wherein the door is a full view door, a high view door, or a mid-view door.

6. The door assembly of embodiments 1-4, wherein the door comprises seasonably exchangeable glass and/or screen panels, or glass and/or screen panels storable in designated sections of the door.

7. The door assembly of embodiments 1, 2 or 4, wherein the door can be installed as a left or right hinged door.

8. The door assembly of embodiments 1-4 further comprising a vertical hinge frame attached to at least one of the vertical stiles.

9. The door assembly of embodiments 1-4 further comprising a latch mechanism having latching components attachable to at least one of the vertical stiles.

10. The door assembly of embodiment 9, wherein the latch mechanism is externally mounted to at least one of the vertical stiles.

11. The door assembly of embodiment 9, wherein the latch mechanism is internally mounted in a latch pocket in at least one of the vertical stiles.

12. The door assembly of embodiments 1-4 further comprising a vertical latch frame attached to a door jamb adjacent at least one of the vertical stiles and having optional fixtures to receive the latching components of the latch mechanism.

13. The door assembly of embodiments 1-4, wherein the slide track is an integral component of the drip cap.

14. The door assembly of embodiments 1-4, wherein the slide track is a component attachable to the drip cap.

15. The door assembly of embodiments 1-4 further comprising an expander attachable to the lower horizontal rail.

16. The door assembly of embodiments 1-4, wherein the biasing mechanism provides a torsional force or linear force.

17. The door assembly of embodiments 1-4, wherein the closer closes the door at a consistent speed or a variable speed.

18. The door assembly of embodiments 1-4, wherein the vertical pinion has upper and lower connecting studs extending through a top and bottom of the closer body, and wherein the connecting stud rotates clockwise when the closer is in a first orientation in the closer pocket, and counterclockwise when the closer is in a second orientation in the closer pocket.

19. The door assembly of embodiments 1-4, wherein the pinion has two connecting studs extending through either the top or bottom of the closer body, and wherein one connecting stud rotates clockwise when the closer is in a the closer pocket, and the other connecting stud rotates counterclockwise when the closer is in the closer pocket.

20. The door assembly of embodiments 1-4, wherein the connecting stud rotates either clockwise or counterclockwise when displaced from a center biased position.

21. The door assembly of embodiments 1-4 wherein the closer comprises a dampener.

22. The door assembly of embodiments 1-4 wherein the closer comprises one or more mounting tabs fastened to the closer body to attach the closer to the horizontal rail.

23. The door assembly of embodiments 1, 2 or 4 further comprising a cover attachable to the upper or lower horizontal rail to conceal at least one of an unused closer pocket.

24. The door assembly of embodiments 1-4 further comprising a hold-open stop associated with the slide track.

25. The door assembly of embodiments 1-4, wherein the closer arm comprises two or more linked segments.

Door Assembly Kit

26. Another embodiment is a door assembly kit comprising:

a door having first vertical latch stile and a second vertical stile, both stiles attached to upper and lower horizontal rails, the upper horizontal rail optionally having one closer pocket adjacent to a hinge vertical stile, one closer pocket in a center region of the upper horizontal rail, or two closer pockets located in regions of the upper horizontal rail adjacent to the first and second vertical stiles, and the lower horizontal rail optionally having one closer pocket adjacent to a hinge vertical stile or having one closer pocket in a center region of the lower horizontal rail;

a drip cap having a horizontal body with first and second ends;

a slide track associated with the drip cap horizontally extending between the first and second ends of the drip cap;

a closer insertable into one of the pockets of the upper horizontal rail comprising a closer body having one or more mounting tabs fastened to the top or bottom of the closer body attached to the upper horizontal rail, and a vertical pinion rotatably connected to an internal biasing mechanism and having at least one connecting stud extending through the closer body, wherein the vertical pinion provides sufficient rotational force to move the door from an opened position to a closed position;

a closer arm having an attachment fixture on one end of the closer arm attached to the vertical pinion connecting stud and a slide fixture on an opposite end of the closer arm insertable into the slide track;

an optional expander attachable to the lower horizontal rail;

a latch mechanism having latching components attachable to at least one of the vertical stiles in either an internal or an external configuration;

a vertical latch frame having optional fixtures to receive the latching components of the latch mechanism;

a vertical hinge frame attachable to at least one of the vertical stiles to provide either a left or right hinged door;

an optional cover attachable to the upper or lower horizontal rails to conceal at least one of the closer pockets;

an optional hold-open stop in the slide track;

an optional linked, segmented closer arm; and an optional screen insert, or one or more glass inserts, or both.

27. The door kit of embodiment 26, wherein the door is a full view door, a high view door, or a mid-view door.

28. The door kit embodiment 26, wherein the door comprises seasonably exchangeable glass and/or screen panels, or glass and/or screen panels storable in designated sections of the door.

29. The door kit of embodiment 26, wherein the latch mechanism is externally mounted to at least one of the vertical stiles.

30. The door kit of embodiment 26, wherein the latch mechanism is internally mounted in a latch pocket in at least one of the vertical stiles.

31. The door kit of embodiment 26, wherein the slide track is an integral component of the drip cap.

32. The door kit of embodiment 26, wherein the slide track is a component attachable to the drip cap.

33. The door kit of embodiment 26, wherein the biasing mechanism provides a torsional force or linear force.

34. The door kit of embodiment 26, wherein the closer closes the door at a consistent speed or a variable speed.

35. The door kit of embodiment 26, wherein the vertical pinion has upper and lower connecting studs extending through a top and bottom of the closer body, and wherein the connecting stud rotates clockwise is in a first orientation in the closer pocket, and counterclockwise in a second orientation in the closer pockets.

36. The door kit of embodiment 26, wherein the pinion has two connecting studs extending through either the top or bottom of the closer body, and wherein one connecting stud rotates clockwise when the closer is in a the closer pocket, and the other connecting stud rotates counterclockwise when the closer is in the closer pocket 37. The door kit of embodiment 26, wherein the connecting stud rotates either clockwise or counterclockwise when displacement from a center biased position.

38. The door kit of embodiment 26 wherein the closer comprises a dampener.

39. The door kit of embodiment 26 wherein the closer comprises one or more mounting tabs fastened to the closer body to attach the closer to the horizontal rail 40. The door kit of embodiment 26 further comprising a cover attachable to the upper or lower horizontal rail to conceal at least one of an unused closer pocket.

41. The kit of embodiment 26 further comprising a hold-open stop associated with the slide track.

42. The door kit of embodiment 26, wherein the closer arm comprises two or more linked segments.

Method of Mounting Door

43. Still another embodiment is a method of mounting a door within a framed door opening comprising:

a) providing a door assembly comprising 1) a door having vertical latch stile and a vertical hinge stile, both stiles attached to upper and lower horizontal rails, the upper horizontal rail optionally having one closer pocket adjacent to a vertical hinge stile, one closer pocket in a center region of the upper horizontal rail, or two closer pockets located in regions of the upper horizontal rail adjacent to the vertical latch and hinge stiles, and the lower horizontal rail optionally having one closer pocket adjacent to a hinge vertical hinge stile, or one closer pocket on a center region of the lower horizontal rail;

2) a drip cap having a horizontal body with first and second ends;

3) a slide track associated with the drip cap horizontally extending between the first and second ends of the drip cap;

4) a closer insertable into one of the pockets of the upper or lower horizontal rails comprising a closer body having first and second mounting tabs fastened to the top or bottom of the closer body attachable to the upper horizontal rail or lower horizontal rail, and a vertical pinion rotatably connected to a biasing mechanism such as an internal biasing spring and having at least one connecting stud extending through the closer body, wherein the vertical pinion provides sufficient rotational force to move the door from an opened position to a closed position;

5) a closer arm having an attachment fixture on one end of the closer arm attached to the vertical pinion connecting stud and a slide fixture on an opposite end of the closer arm insertable into the slide track;

6) an optional expander attachable to the second lower horizontal rail;

7) a latch mechanism having latching components attachable to at least one of the vertical stiles in either in external or internal configuration;

8) a vertical latch frame having optional fixtures to receive the latching components of the latch mechanism;

9) a vertical hinge frame attachable to at least one of the vertical stiles to provide either a left or right hinged door;

10) an optional cover attachable to the upper or lower horizontal rail to conceal at least one of the unused closer pockets;

11) an optional hold-open stop in the slide track;

12) an optional linked, segmented closer arm; and 13) an optional screen insert, or one or more glass inserts, or both;

b) attaching the vertical hinge stile of the door assembly to a door jamb with the vertical hinge frame;

c) inserting the slide fixture and optional hold-open stop into the slide track;

d) attaching the drip cap to the door header;

e) attaching the vertical latch frame to the door jamb adjacent the vertical latch stile;

f) attaching the latch mechanism externally to or internally in the vertical latch stile;

g); attaching the closer arm to one of the closer pinion connecting studs;

h) inserting the closer into one of the closer pockets in the upper or lower horizontal rail and attaching the closer to the rail;

i) attaching the closer arm to the sliding fixture;

j) attaching the optional cover to conceal at least one of the unused closer pockets;

k) attaching the optional expander to the lower horizontal rail and l) attaching the screen insert and/or one or more glass inserts in the door.

44. The method of embodiment 43, wherein the door is a full view door, a high view door, or a mid-view door.

45. The method of embodiment 43, wherein the door comprises seasonably exchangeable glass and/or screen panels, or glass and/or screen panels storable in designated sections of the door.

46. The method of embodiment 43, wherein the latch mechanism is externally mounted to at least one of the vertical stiles.

47. The method of embodiment 43, wherein the latch mechanism is internally mounted in a latch pocket in at least one of the vertical stiles.

48. The method of embodiment 43, wherein the slide track is an integral component of the drip cap.

49. The method of embodiment 43, wherein the slide track is a component attachable to the drip cap.

50. The method of embodiment 43, wherein the biasing mechanism provides a torsional force or linear force.

51. The method of embodiment 43, wherein the closer closes the door at a consistent speed or a variable speed.

52. The method of embodiment 43, wherein the vertical pinion has upper and lower connecting studs extending through a top and bottom of the closer body, and wherein the connecting stud rotates clockwise when the closer is in a first orientation in the closer pocket, and counterclockwise when the closer is in a second orientation in the closer pocket.

53. The method of embodiment 43, wherein the pinion has two connecting studs extending through either the top or bottom of the closer body, and wherein one connecting stud rotates clockwise when the closer is in a the closer pocket, and the other connecting stud rotates counterclockwise when the closer is in the closer pocket 54. The method of embodiment 43, wherein the connecting stud rotates either clockwise or counterclockwise when displacement from a center biased position.

55. The method of embodiment 43, wherein the closer comprises a dampener.

56. The method of embodiment 43, wherein the closer comprises one or more mounting tabs fastened to the closer body to attach the closer to the horizontal rail.

57. The method of embodiment 43 further comprising a cover attachable to the upper or lower horizontal rail to conceal at least one of an unused closer pocket.

58. The method of embodiment 43 further comprising a hold-open stop associated with the slide track.

59. The method of embodiment 43, wherein the closer arm comprises two or more linked segments.

The invention claimed is:

1. A door assembly, comprising:

a door having first and second vertical edges and first and second horizontal edges, the door comprising a first door portion along the first horizontal edge and a second door portion along the second horizontal edge, the door further comprising at least one closer pocket within one of the first and second door portions along the respective first and second horizontal edges;

a cap member connectable to a door opening above the first horizontal edge having a horizontal body extending the width of the door with first and second cap member ends and comprising a slide track extending along the horizontal body of the cap member at least partially between the first and the second cap member ends, wherein the cap member is shaped to include a vertical surface for abutting the door opening and at least a first portion to fit on a horizontal surface of the door opening with the slide track positioned at least partially along the first portion of the cap member and wherein the vertical surface is positioned above the first portion when the cap member is fastened to the door opening, and the cap member remains stationary when the door is opened or closed;

a slide fixture inserted into or insertable into the slide track and movable along the slide track of the horizontal body of the connectable cap member;

a closer insertable within or inserted within one of the at least one closer pocket, the closer comprising a closer body, a rotatable component operatively supported to the closer body, and an internal biasing device including a component movable to the closer body and operatively connected with the rotatable component, wherein the rotatable component provides sufficient rotational force to move the door from an opened position toward a closed position; and a closer arm having an attachment fixture on one end of the closer arm that is operatively attachable to or attached to the rotatable component and an opposite end of the closer arm attachable to or attached to the slide fixture.

2. The door assembly of claim 1, wherein the door is a full view door, a high view door, or a mid-view door.

3. The door assembly of claim 1, wherein the door comprises fixed glass, opaque or screen panels or combinations thereof; seasonably exchangeable glass, opaque or screen panels, or combinations thereof; glass, opaque or screen panels, or combinations thereof that are storable in designated sections of the door; or security or primary doors.

4. The door assembly of claim 1, wherein the door can be installed as a left or right hinged door.

5. The door assembly of claim 1, further comprising a hinge element.

6. The door assembly of claim 5, wherein the hinge element comprises a vertical hinge frame attached to or attachable along at least one of the vertical edges.

7. The door assembly of claim 1, further comprising a latch mechanism having latching components attached to or attachable to a portion of the door along one of the vertical edges.

8. The door assembly of claim 7, wherein the latch mechanism is externally mounted to the portion of the door along one of the vertical edges.

9. The door assembly of claim 7, wherein the latch mechanism is internally mounted in a latch pocket within the portion of the door.

10. The door assembly of claim 7 further comprising a vertical latch frame attachable to or attached to a door opening adjacent the one of the vertical edges of the door having the latching components.

11. The door assembly of claim 1, wherein the slide track is an integral component of the cap member, wherein the cap member is a one piece cap member.

12. The door assembly of claim 1, wherein the slide track is a component attached to or attachable to the cap member.

13. The door assembly of claim 1, wherein the biasing device provides a torsional force or linear force to the rotatable component, wherein the biasing device comprises the component movable to the closer body.

14. The door assembly of claim 13, wherein the biasing device provides a rotational torque to the rotatable component by way of a linear element operatively positioned between the biasing device and the rotatable component, wherein the linear element also comprises the component movable to the closer body.

15. The door assembly of claim 1, wherein the rotatable component has upper and lower connecting studs extending through a top and bottom of the closer body, and wherein the connecting studs rotate clockwise when the closer is in a first orientation in the closer pocket, and counterclockwise when the closer is in a second orientation in the closer pocket.

16. The door assembly of claim 1, wherein the rotatable component has two connecting studs extending through either the top or bottom of the closer body, and wherein one connecting stud rotates clockwise when the closer is in the closer pocket, and the other connecting stud rotates counterclockwise when the closer is in the closer pocket.

17. The door assembly of claim 1, wherein the rotatable component rotates either clockwise or counterclockwise when displaced from a center biased position.

18. The door assembly of claim 1, further comprising a cover positioned along or positionable along the first door portion extending along the first horizontal edge or the second door portion extending along the second horizontal edge to conceal at least one of an unused closer pocket.

19. The door assembly of claim 1, further comprising a hold-open stop adjustably positionable and associated with the slide track.

20. The door assembly of claim 1, wherein the closer pocket is provided along the first horizontal edge with the closer pocket being open for access from the first vertical edge.

21. The door assembly of claim 1, wherein the closer pocket is provided along the first horizontal edge with the closer pocket being open for access from the first horizontal edge.

22. The door assembly of claim 1, wherein the closer pocket is provided along the first horizontal edge with the closer pocket being open from a front or back face of the door.

23. The door assembly of claim 1, wherein the cap member comprises a drip cap that is shaped to extend over the first or second door portion as an upper door portion for diverting fluid from above toward at least one cap member end.

24. A door assembly, comprising:

a door having first and second vertical edges and first and second horizontal edges, the door comprising a first door portion along the first horizontal edge and a second door portion along the second horizontal edge, the door further comprising at least one closer pocket within one of the first and second door portions along the respective first and second horizontal edges;

a cap member connectable to a door opening above the first horizontal edge having a horizontal body extending the width of the door with first and second cap member ends and comprising a slide track extending along the horizontal body of the cap member at least partially between the first and the second cap member ends, wherein the cap member is shaped to fit in position relative to the door opening with the cap member positioned with at least a portion of the cap member positioned directly above the first horizontal edge when the door is closed, and the cap member remains stationary when the door is opened or closed;

a slide fixture inserted into or insertable into the slide track and movable along the slide track of the horizontal body of the connectable cap member;

a closer insertable within or inserted within one of the at least one closer pocket, the closer comprising a closer body, a rotatable component operatively supported to the closer body, and an internal biasing device including a component movable to the closer body and operatively connected with the rotatable component, wherein the rotatable component provides sufficient rotational force to move the door from an opened position toward a closed position; and a closer arm having an attachment fixture on one end of the closer arm that is operatively attachable to or attached to the rotatable component and an opposite end of the closer arm attached to or attachable to the slide fixture.

25. The door assembly of claim 24, wherein the slide track is an integral component of the cap member, wherein the cap member is a one piece cap member.

26. The door assembly of claim 24, wherein the slide track is a component attached to or attachable to the cap member.

27. The door assembly of claim 24, wherein the cap member comprises a drip cap that is shaped to extend over the first or second door portion as an upper door portion for diverting fluid from above toward at least one cap member end.

* * * * *